US005789089A

United States Patent [19]

Maki et al.

[11] Patent Number: 5,789,089

[45] Date of Patent: Aug. 4, 1998

[54] HOT-DIPPED ALUMINUM COATED STEEL SHEET HAVING EXCELLENT CORROSION RESISTANCE AND HEAT RESISTANCE, AND PRODUCTION METHOD THEREOF

[75] Inventors: Jun Maki; Takayuki Ohmori; Masaaki Enjuji; Haruhiko Eguchi; Masaaki Yamamoto; Yu Ando; Yusho Oyama; Nobuyoshi Okada, all of Kitakyushu, Japan

[73] Assignee: Nippon Steel Corporation, Tokyo, Japan

[21] Appl. No.: 649,363

[22] Filed: May 17, 1996

[30] Foreign Application Priority Data

| | | | |
|---|---|---|---|
| May 31, 1995 | [JP] | Japan | 7-132993 |
| May 31, 1995 | [JP] | Japan | 7-132994 |
| May 25, 1995 | [JP] | Japan | 7-126110 |
| May 25, 1995 | [JP] | Japan | 7-126111 |
| May 25, 1995 | [JP] | Japan | 7-126112 |
| May 25, 1995 | [JP] | Japan | 7-126247 |
| May 18, 1995 | [JP] | Japan | 7-119461 |
| Dec. 8, 1995 | [JP] | Japan | 7-320684 |
| Jan. 24, 1996 | [JP] | Japan | 8-009673 |

[51] Int. Cl.[6] ..... B21D 39/00

[52] U.S. Cl. ..... 428/623; 427/405; 427/409; 427/419.2; 427/436; 428/626; 428/652; 428/653; 428/654; 428/682; 428/684; 428/685; 428/939

[58] Field of Search ..... 428/653, 654, 428/684, 685, 682, 939, 623, 626, 632; 420/548, 550, 78, 79; 427/405, 409, 419.2, 436

[56] References Cited

U.S. PATENT DOCUMENTS

| | | | |
|---|---|---|---|
| 3,841,894 | 10/1974 | Leonard | 117/50 |
| 4,546,051 | 10/1985 | Uchida et al. | 428/653 |
| 4,727,929 | 3/1988 | Shinoda et al. | 428/653 |
| 4,891,274 | 1/1990 | Higuchi et al. | 428/653 |

FOREIGN PATENT DOCUMENTS

| | | |
|---|---|---|
| A-8500386 | 1/1985 | European Pat. Off. . |
| A-575926 | 12/1993 | European Pat. Off. . |
| A-2200373 | 4/1974 | France . |
| 56-23265 | 3/1981 | Japan . |
| 49-93232 | 5/1982 | Japan . |
| 58-81855 | 10/1983 | Japan . |
| 60-243258 | 12/1985 | Japan . |
| 62-120494 | 6/1987 | Japan . |
| 2-153059 | 6/1990 | Japan . |
| A-2118211 | 10/1983 | United Kingdom . |

OTHER PUBLICATIONS

Patent Abstracts of Japan, vol. 12, No. 5, (C–467), Jan. 8, 1988 & JP–A–62 161944 (Nisshin Steel), Jul. 17, 1987.

Patent Abstracts of Japan, vol. 17, No. 46 (C–1021), Jan. 28, 1993 & JP–A–04 259363 (Nippon Steel Corp.), Sep. 14, 1992.

Patent Abstracts of Japan, vol. 17, No. 589 (C–1124), Oct. 27, 1993 & JP–A–05 171393 (Sumitomo Metal), Jul. 9, 1993.

Patent Abstracts of Japan, vol. 5, No. 178 (C–078), Nov. 14, 1981 & JP–A–56 102556 (Nisshin Steel), Aug. 17, 1981.

*Primary Examiner*—Paul J. Thibodeau
*Assistant Examiner*—Holly C. Rickman
*Attorney, Agent, or Firm*—Kenyon & Kenyon

[57] ABSTRACT

A hot-dipped aluminum coated steel sheet including, on the surface thereof, a coating layer consisting of 2 to 15 wt % of Si, not greater than 1.2 wt % of Fe, 0.005 to 0.6 wt % of Mn, 0.002 to 0.05 wt % of Cr and the balance of Al and unavoidable impurities, and an alloy layer disposed between the coating layer and the steel sheet, having a thickness of not greater than 7 μm and having a mean composition consisting of 20 to 50 wt % of Fe, 3 to 20 wt % of Si, 0.1 to 10 wt % of Mn, 0.05 to 1.0 wt % of Cr and the balance substantially consisting of Al. This steel sheet can be produced by conducting coating in a coating bath consisting of 3 to 15 wt % of Si, 0.5 to 3.5 wt % of Fe, 0.05 to 1.5 wt % of Mn, 0.01 to 0.2 wt % of Cr and the balance substantially consisting of Al, or by adjusting the sum of the concentrations of Zn and Sn in the impurities in the coating layer to not greater than 1 wt %.

13 Claims, 1 Drawing Sheet

HOT-DIPPED ALUMINUM COATED STEEL SHEET HAVING EXCELLENT CORROSION RESISTANCE AND HEAT RESISTANCE, AND PRODUCTION METHOD THEREOF

BACKGROUND OF THE INVENTION

1. Field of the Invention

This invention relates to a hot-dipped aluminum coated steel sheet having excellent corrosion resistance and heat resistance, which is mainly used as a material for automobile exhaust systems, building materials, home electric appliances, various heating devices, and so forth, and a production method thereof.

2. Description of the Related Art

A hot-dipped aluminum coated steel sheet is a steel sheet having an aluminum coating layer mainly comprising aluminum (Al) (hereinafter referred to as the "coating layer") and a layer comprising intermetallic compounds as the reaction products between the steel sheet to be coated and At (hereinafter referred to as the "alloy layer"), and has excellent corrosion resistance and heat resistance, as is well known in the art. The hot-dipped aluminum coated steel sheet has been widely used as a material for automobile exhaust systems, buildings, home electric appliances, various heating devices, roofs, walls, etc, by utilizing these features. A stainless steel sheet also has excellent corrosion resistance and heat resistance. However, because the hot-dipped aluminum coated steel sheet is more economical than the stainless steel sheet, its application has become wider in recent years.

As the need for products having further improved corrosion resistance and heat resistance have increased, various inventions have been made which add various elements to the raw steel sheet. For example, Japanese Examined Patent Publication (Kokoku) No. 3-48260 discloses a Cr-containing steel in which Cr is added to the base steel sheet for the application where the corrosion resistance is requisite, and Japanese Examined Patent Publication (Kokoku) No. 2-61541 discloses a Ti-containing steel in which Ti is added to a base steel sheet for an application where the heat resistance is requisite. Further, Japanese Unexamined Patent Publication (Kokai) No. 2-153059 discloses an example where a stainless steel sheet is used for the base steel sheet.

To improve the corrosion resistance, on the other hand, various attempts have been made to add various elements effective for improving the corrosion resistance to an aluminum coating bath. For example, Japanese Examined Patent Publication (Kokoku) No. 63-23264 discloses a coating layer containing not greater than 3% of Si and 0.5 to 4% of Mn, and Japanese Examined Patent Publication (Kokoku) No. 2-61541 discloses a production method for a coated steel sheet which adds 0.05 to 2% of Cr to the coating bath.

Japanese Unexamined Patent Publication (Kokai) Nos. 58-18185 and 62-120494 are prior art examples which add both of Mn and Cr into the aluminum coating layer in order to improve the corrosion resistance. The former relates to Al-Zn system coating, and Zn exists as an indispensable element. The term "coating layer" appears in the description of the latter, but it is not clear whether this term represents both the coating layer and the alloy layer. Judging from the description of this reference, the term presumably represents the coating layer. (The specification discloses that a thick Al-Si system alloy layer having low machinability is formed on the interface between the coating layer and the steel sheet.) In any way, this reference is based on the technical concept which improves machinability of the coating layer by forming it as a coating layer merely containing Mn, Cr and Ti, and improves the corrosion resistance by the chromate coat film on the coating layer. Therefore, this reference does not at all mention the contribution of Mn and Cr to the corrosion resistance and does not at all mention the effect achieved when these elements are both added. Examples of the reference describe merely that when Mn, Cr and Ti are individually added, machinability can be improved. Furthermore, the reference describes that at least 0.1% of Cr is necessary for the coating layer in order to improve machinability.

However, each of the inventions described above is not free from the following problems. When Cr is added to the steel so as to improve the corrosion resistance, for example, the corrosion resistance itself can be improved, it is true, but steel making, hot rolling, cold rolling and pickling become particularly difficult during the steel production process, and each of these production process steps becomes equivalent to that of the stainless steel production process, so that the production cost eventually increases. Since different kinds of steels are necessary such as for applications requiring corrosion resistance, heat resistance, etc, the production process and management for each application become necessary and production management becomes extremely troublesome.

Even when Mn and Cr are co-present in the coating layer, the corrosion resistance and the heat resistance brought forth by the synergistic effect of composite addition of Mn and Cr have not yet been clarified sufficiently at present.

On the other hand, those inventions which add the elements into the coating bath can certainly improve the corrosion resistance of the coating layer, but the corrosion resistance after the coating layer is lost due to corrosion is equivalent to the corrosion resistance of ordinary aluminum coated steel sheets. Therefore, these inventions cannot provide the sufficient effect from the aspect of prolongation of the service life of the steel sheet.

In addition to the composition of the aluminum coating bath composition described above, the composition of the steel sheet as the base sheet of the aluminum coated steel sheet has not yet been clarified sufficiently in connection with its corrosion resistance and heat resistance.

Further, products equipped with an organic coat film for improving the corrosion resistance depending on various applications are known. For example, the coated steel sheets having two layers of a primer and a top coat (2-coat 2-bake) and coated steel sheets having a transparent resin coat exploiting the base skin of aluminum (1-coat 1-bake) have been put on the market. Particularly, the former is a colored steel sheet containing various rust-proofing pigments and body pigments. When such coated aluminum coated steel sheets are used for building materials, corrosion from edge portions (edge creep) is a critical problem. This problem is observed in common in the coated steel sheets, in general, and the edge creep of these steel sheets at the initial stage is generally greater than that of zinc coated steel sheets. This is presumably because Si and Fe existing in the aluminum coating layer (existing as the intermetallic compounds), etc, become electrically rich, and this portion functions as the cathode and invites anodic dissolution of aluminum. The progress of the edge creep for an extended period is slow and the creep width gradually becomes smaller than that of the coated zinc coated steel sheet, but since the edge creep at the initial stage is great, an improvement in this point has been required. Japanese Examined Patent Publication (Kokoku)

No. 1-14866 is an example of the inventions which solve this problem by blending calcium carbonate as the body pigment into the primer coat of the 2-coat 2-bake type coated steel sheets and prevent the edge creep. However, because this invention uses calcium carbonate as the pigment, restriction of the edge creep by this pigment can be applied to only the 2-coat 2-bake types, but cannot be applied to the 1-coat 1-bake type for which transparency is an indispensable requirement.

Furthermore, the following problem occurs when the aluminum coated steel sheet is used as a building material or as a material for an automobile fuel tank. In other words, cracks are likely to occur in the alloy layer and in the coating layer during machining of the aluminum coated steel sheet, and once such cracks develop, red rust occurs from the base iron in the case of the building material and results in poor appearance. In the case of the fuel tank, corrosion of the base occurs from these cracks and invites a drastic drop in service life. To cope with this problem, various methods have been proposed, and the Applicant of the present invention also proposed, in Japanese Unexamined Patent Publication (Kokai) No. 6-128713, a method which conducts heat-treatment after coating, and carries out precipitation treatment of the Fe that has undergone solid solution into supersaturation, so as to soften the coating layer. Because this method requires a long processing time, however, the process becomes BAF annealing and is not yet free from the problems in the aspects of productivity and the cost of production.

Moreover, in the production of the hot-dipped aluminum coated steel sheet, a production method for obtaining the optimum aluminum coated layer and the optimum alloy layer, and a production method for producing the hot-dipped aluminum coated steel sheet on the basis of the coating bath composition matching the composition of the steel sheet, have not yet been established.

SUMMARY OF THE INVENTION

The first object of the present invention provides a novel hot-dipped aluminum coated steel sheet having excellent corrosion resistance and excellent heat resistance.

The second object of the present invention provides a hot-dipped aluminum coated steel sheet including a hot-dipped aluminum coating layer having the optimum component composition and an alloy layer sandwiched between the coating layer and the base sheet to be coated, and to provide a hot-dipped aluminum coating bath composition in order to obtain this optimum component composition.

It is the third object of the present invention to provide a steel sheet composition which is most suitable as a base sheet of the hot-dipped aluminum coated steel sheet in accordance with various applications.

It is the fourth object of the present invention to provide a hot-dipped aluminum coated steel sheet which includes a chromate processed coat film and an organic resin coat film on the hot-dipped aluminum coating layer described above to further improve the corrosion resistance.

It is the fifth object of the present invention to provide a method which applies annealing for a short time after aluminum coating is carried out with an optimum coating bath composition so as to soften a coating layer, and to prevent cracks, having the start points thereof at the alloy layer, and occuring during machining, from penetrating through the coating layer.

Finally, the present invention provides the optimum production method for the hot-dipped aluminum coated steel sheet.

BRIEF DESCRIPTION OF THE DRAWING

The sole drawing is an explanatory view for explaining a molding shape and procedure of a reverse bending method as an evaluation method for the adhesion of coating.

DESCRIPTION OF THE PREFERRED EMBODIMENTS

Figure 1:
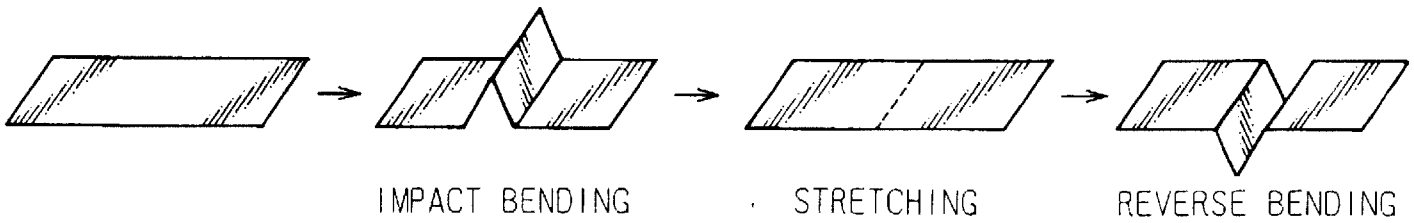

The inventors of the present invention have conducted various experiments on the properties of a coating layer and an alloy layer that affect various properties of a hot-dipped aluminum coated steel sheet, and have made the following observation. When Mn and Cr are compositely added to an aluminum coating bath, these elements are not dispersed uniformly into the coating layer but are remarkably concentrated in the alloy layer. This is the phenomenon first observed when the elements are compositely added. More concretely, the concentrations of these elements in the coating layer are about 1/5 to about 1/10 of the amounts added, and the rest are concentrated in the alloy layer. These elements are concentrated particularly near the interface between the coating layer and the alloy layer in the alloy layer.

From the aspect of the corrosion resistance, on the other hand, the corrosion resistance can be improved by adding Cr to the coating layer as described in Japanese Examined Patent Publication (Kokoku) No. 6-11906. It has been found out further that both the corrosion resistance and the heat resistance can be remarkably improved presumably because the Mn and the Cr concentrated on the coating layer side of the alloy layer improve the corrosion resistance when corrosion occurs.

Sn, Zn, in the coating bath are elements which remarkably impede the corrosion resistance of the hot-dipped aluminum coated steel sheet. Therefore, the present invention can obtain a hot-dipped aluminum coated steel sheet having excellent corrosion resistance and heat resistance by adding Mn and Cr as described above and by limiting the Sn and Zn impurities to below predetermined amounts. Further, this coating bath composition can obtain a hot-dipped aluminum coated steel sheet having excellent corrosion resistance and heat resistance by adding specific amounts of Mn, Cr, Fe and Si, or by adding specific amounts of Mn, Cr, Fe and Si and moreover, limiting the Sn and Zn in the impurities to below the specific amounts.

In addition, the present invention has clarified the composition of a raw sheet for a hot-dipped aluminum coated steel sheet having both excellent corrosion resistance and heat resistance.

In other words, features of the present invention reside in the following points.

1. A hot-dipped aluminum coated steel sheet excellent in both corrosion resistance and heat resistance, comprising:

a coating layer disposed on the surface of said steel sheet, and consisting of, in terms of percentage by weight:

Si: 2 to 15%,

Fe: not greater than 1.2%,

Mn: 0.005 to 0.6%,

Cr: 0.002 to 0.05%, and the balance of Al and unavoidable impurities, wherein the sum of Sn and Zn in said impurities is not greater than 1%; and an alloy layer disposed between the steel sheet and the coating layer, having a thickness of not greater than 7 μm, and having a mean composition consisting of, in terms of percentage by weight:

Fe: 20 to 50%,

Si: 3 to 20%,

Mn: 0.1 to 10%,

Cr: 0.05 to 1%, and the balance of At and unavoidable impurities.

2. A coated hot-dipped aluminum coated steel sheet for a building material excellent in both corrosion resistance and heat resistance according to the item 1, wherein a chromate processed coat film and an organic resin coat film on the chromate processed coat film are disposed on the surface of the coating layer of said hot-dipped aluminum coated steel sheet.

3. A hot-dipped aluminum coated steel sheet excellent in both corrosion resistance and heat resistance according to the item 2, wherein the organic resin coat film is transparent and has a thickness of 1 to 15 μm.

4. A hot-dipped aluminum coated steel sheet excellent in corrosion resistance and heat resistance according to the item 1, wherein the steel components of the steel sheet consist of, in terms of:

C: not greater than 0.02%,

Mn: 0.1 to 0.6%,

Ti: 0.1 to 0.5%,

N: not greater than 0.004%,

Al: 0.01 to 0.08%, and the balance substantially consisting of Fe and unavoidable impurity elements.

5. A hot-dipped aluminum coated steel sheet excellent in both corrosion resistance and heat resistance according to the item 4, wherein the steel components of the steel sheet contains not greater than 1% of Cr in terms of percentage by weight.

6. A hot-dipped aluminum coated steel sheet excellent in both corrosion resistance and heat resistance according to the item 1, wherein the steel components of the steel sheet contains, in terms of percentage by weight:

at least one of the members selected from the group consisting of not greater than 1.5% of Si, not greater than 0.1% of P and not greater than 0.0003% of B, in addition to the steel composition consisting of, in terms of percentage by weight:

C: not greater than 0.02%,

Mn: 0.6 to 2%,

Ti: 0.1 to 0.5%,

N: not greater than 0.004%,

Al: 0.01 to 0.08%, and the balance substantially consisting of Fe and unavoidable impurity elements.

7. A hot-dipped aluminum coated steel sheet excellent in both corrosion resistance and heat resistance according to the item 1, wherein the steel components of the steel sheet consists of, in terms of percentage by weight:

C: not greater than 0.01%,

Si: not greater than 0.1%,

N: 0.0015 to 0.006%,

Al: not greater than 0.01%, and the balance substantially consisting of Fe and unavoidable impurity elements.

8. A chromium-containing type hot-dipped aluminum coated steel sheet excellent in both corrosion resistance and heat resistance according to the item 1, wherein the steel components of the steel sheet consist of, in terms of percentage by weight:

C: not greater than 0.02%,

Mn: 0.1 to 1.5%,

Si: not greater than 0.2%,

Ti: 0.1 to 0.5%,

Cr: 1 to 9%,

N: not greater than 0.004%,

Al: 0.01 to 0.08%, and the balance substantially consisting of Fe and unavoidable impurity element.

9. A stainless type hot-dipped aluminum coated steel sheet excellent in both corrosion resistance and heat resistance, comprising a stainless steel sheet containing, as steel components thereof, in terms of percentage by weight:

C: not greater than 0.02%,

Mn: 0.1 to 1.5%,

Si: not greater than 0.2%,

Ti: 0.1 to 0.5%,

Cr: 10 to 25%,

N: not greater than 0.004%,

Al: 0.01 to 0.08%, at least one of the members selected from the group consisting of:

Ni: 0.1 to 1%,

Mo: 0.1 to 2%, and

Cu: 0.1 to 1%; and the balance substantially consisting of Fe and unavoidable impurity elements; the steel sheet including:

a coating layer consisting of, in terms of percentage by weight:

Si: 2 to 15%,

Fe: not greater than 1.2%,

Mn: 0.005 to 0.6%,

Cr: 0.05 to 0.2%, and the balance consisting of Al and unavoidable impurities, wherein the sum of Sn and Zn in the unavoidable impurities is not greater than 1%, and disposed on the surface of the steel sheets; and an alloy layer disposed between the steel sheet and the coating layer, having a thickness of not greater than 7 μm and having a mean composition consisting of, in terms of percentage by weight:

Fe: 20 to 50%,

Si: 3 to 20%,

Mn: 0.1 to 10%,

Cr: 1 to 5%, and the balance consisting of Al and unavoidable impurities.

10. A production method of a hot-dipped aluminum coated steel sheet excellent in both corrosion resistance and heat resistance, comprising:

forming a coating layer consisting of, in terms of percentage by weight:

Si: 2 to 15%,

Fe: not greater than 1.2%,

Mn: 0.005 to 0.6%,

Cr: 0.002 to 0.05%, and the balance consisting of Al and unavoidable impurities, wherein the sum of Sn and Zn in the impurities is not greater than 1%; on the surface of a steel sheet; and forming an alloy layer between the steel sheet and the coating layer, having a thickness of not greater than 7 μm and having a mean composition consisting of, in terms of percentage by weight:

Fe: 20 to 50%,

Si: 3 to 20%,

Mn: 0.1 to 10%,

Cr: 0.05 to 1%, and the balance consisting of Al and unavoidable impurities;

by using a coating bath having a composition consisting of:

Si: 3 to 15%,

Fe: 0.5 to 3.5%,

Mn: 0.05 to 1.5%,

Cr: 0.01 to 0.2%, and the balance consisting of Al and unavoidable impurities, wherein the sum of Sn and Zn in the impurities is not greater than 1%.

11. A production method of a hot-dipped aluminum coated steel sheet excellent in both corrosion resistance and heat resistance according to the item 10, wherein a Cr concentration in the coating bath is 0.01 to less than 0.1% in terms of percentage by weight.

12. A production method of a hot-dipped aluminum coated steel sheet excellent in both corrosion resistance and heat resistance according to the item 10, wherein a deposition quantity of the coating layer is at least 60 g/m$^2$ on both surfaces, and heat-treatment is carried out in a region encompassed by the following coordinates A, B, C, D, E and F:

A: (5 seconds, 510° C.), D: (30 hours, 300° C.),

B: (1 minute, 530° C.), E: (1 minute, 300° C.),

C: (30 hours, 530° C.), F: (5 seconds, 450° C.).

13. A production method of a coated hot-dipped aluminum coated steel sheet for a building material according to the item 12, wherein chromate processing and resin coating are carried out in succession to hot-dipped aluminum coating.

The reasons for limitations in the present invention now will be explained. First, the composition of the coating layer and the composition of the coating bath will be explained.

Si: The coating layer and the alloy layer are formed on the hot-dipped aluminum coated steel sheet. This alloy layer is hard and brittle, and impedes coating adhesion. To reduce this adverse influence, Si is generally added in an amount of about 10% into the coating bath so as to restrict the growth of the alloy layer. In the present invention, too, Si is added for the same purpose. To accomplish this object, at least 3% of Si is necessary in the coating bath and at this time, the Si amount in the coating layer becomes about 2%. When a large amount of Si is added, on the other hand, a large amount of Si of the primary phase is formed in the coating layer and the corrosion resistance is adversely affected. Therefore, the upper limit is set to 15%. The Si amount in both the coating layer and the coating bath at this time is 15%.

Fe: Fe is eluted from the steel sheet to be coated or from devices inside the bath, and is not positively added in the present invention, in particular. Generally, about 0.2 to about 0.8% of Fe is contained in the coating layer, too. Since Fe adversely affects the corrosion resistance, its amount is preferably small, and the upper limit value in the coating layer is set to 1.2%. Preferably and originally, the smaller the Fe amount, the better, but it is very difficult to completely eliminate this element which mixes unavoidably as described above. Fe is also an unavoidable element in the bath, too, and its removal is almost impossible. When an attempt is made to compulsively remove Fe, elution from the devices in the bath is likely to occur. Therefore, the lower limit value in the bath is set to 0.5%, and the upper limit value in the bath is set to 3.5% because contamination of appearance is likely to occur due to dross.

Mn: This element is particularly important in the present invention. When concentrated in the alloy layer, Mn remarkably improves the corrosion resistance and the heat resistance. To exploit its effect, at least 0.05% of Mn must be added to the coating bath. When coating is carried out in this coating bath, at least 0.005% of Mn is contained in the coating layer, and this concentration is set as the lower limit value in the coating layer. On the other hand, solubility of Mn in the coating bath is about 0.7% at 650° C. which is an ordinary coating temperature. In an Al-Mn binary system state diagram, solubility of Mn is about 2%, but solubility is believed to drop in a coating bath containing Si, Fe, and so forth. In order to dissolve at least 0.7% of Mn, therefore, the bath temperature must be raised, but when the bath temperature is raised, there occurs the problem that the alloy layer grows to a large thickness and adhesion is deteriorated. For this reason, the upper limit of the Mn concentration inside the bath is set to 1.5%. The Mn concentration in the coating layer is maximum about 0.6% when coating is carried out in this bath, and this value is used as the upper limit value of Mn in the coating layer.

Cr: Cr is an important element in the present invention in the same way as Mn. Cr exerts great influences particularly on the corrosion resistance, and promotes the effect of concentrating Mn in the alloy layer. To obtain these effects, at least 0.01% of Cr is necessary in the coating bath. Since about 0.002% of Cr is contained in the coating layer at this time, the lower limit value in the coating layer is set to this value. Further, solubility of Cr in the coating bath is low in the same way as Mn, and is about 0.1% at 650° C. To dissolve a greater amount of Cr, the bath temperature must be raised. Then, the alloy layer grows to a large thickness. Therefore, the upper limit value of the Cr amount in the bath is not greater than 0.2% and preferably, less than 0.1%. Because the Cr amount in the coating layer is about 0.05% when the amount of Cr in the bath is 0.2%, this value is set as the upper limit value of the Cr amount in the coating layer. In the state diagram, solubility of Cr in Al-Cr is about 0.4%, but solubility is believed to drop for the same reason as in the case of Mn.

The reason why Cr and Mn are concentrated in the alloy layer when both elements are compositely added has not yet been clarified, but it is assumed that Cr and Mn migrate towards the base sheet side having a high Fe concentration because stable intermetallic compounds of the Cr-Mn-Fe(-Al-Si) system are formed.

Zn and Sn: These elements greatly impede the corrosion resistance of Al and promote the occurrence of white rust. Therefore, the sum of these elements must be limited to not greater than 1% in both the coating layer and the coating bath.

Next, the reasons for limitation of the composition of the alloy layer will be explained.

Si: As described above, 3 to 15% of Si is added into the coating bath in order to restrict the growth of the alloy layer. The Si concentration in the alloy layer at this time is 3 to 20%. Therefore, the Si amount in the alloy layer is limited to this range.

Fe: The alloy layer is formed primarily by the reaction between At and Si in the coating bath and Fe of the base sheet. The Fe concentration in the alloy layer at this time is 20 to 50%. Therefore, the Fe amount in the alloy layer is limited to this range.

Mn: When added into the bath, Mn is concentrated in the alloy layer due to the effect of Cr and drastically improves various properties such as the corrosion resistance, the oxidation resistance, adhesion, and so forth, as described above. To fully exploit these effects, at least 0.1% of Mn must be added. On the other hand, because the Mn concentration in the bath involves the upper limit, the Mn concentration in the alloy layer, too, involves the upper limit, and its upper limit is set to about 10%.

Cr: Cr is also concentrated in the alloy layer in the same way as Mn. This Cr is also believed to improve the corrosion resistance, and this effect can be obtained when the Cr amount is at least 0.05%. The upper limit value of Cr also depends on the Cr amount that can be added to coating bath, and is 1.0%. Further, when the base sheet is a chromium steel containing 1 to 9% of Cr or a stainless steel containing 10 to 25% of Cr, Cr contained in the steel is diffused into the alloy layer and increases the total Cr amount in the alloy layer. Therefore, the Cr amount of 1 to 5% is permitted.

As to the thickness of the alloy layer, the upper limit is set to 7 μm because a greater thickness impedes adhesion. From the aspect of adhesion, the alloy layer is preferably thinner. Therefore, the lower limit is not set, in particular, but the thickness of the alloy layer is from 2 to 3 μm in the normal operation condition.

Next, various base sheets used for the hot-dipped aluminum coated steel sheet will be explained.

As described already, the steel sheet of the present invention is mainly used for the material of the automobile exhaust system, buildings, home electric appliances, various heating devices, etc, for which the corrosion resistance and the heat resistance are required. Therefore, the component composition of the base sheet is preferably the one that can exploit the characteristic features of the coating layer described above. The inventors of the present invention have sought steel materials which can fully exploit the characteristic features of the hot-dipped aluminum coating, and have found a steel material having the following component composition.

All those base sheets which are used for aluminum coating at present, such as Cr-containing steel, high strength steel containing Mn, Si, P, etc, steel containing sol-N, Cr-containing steel, stainless type materials, etc, in addition to ordinary Al killed steel and IF steel (Interstitial Free steel) containing Ti, Nb, etc, can be used in the present invention, and the present invention particularly stipulates the component compositions that can exploit to maximum the characteristic features of hot-dipped aluminum coating for these base sheets. Since the Ti-IF steel contains Ti that contributes to the heat resistance after aluminum coating, this steel after coating has by far higher heat resistance than the Al killed steel after coating. Though the heat resistance of the Al killed steel can be also greatly improved according to the present invention, the Ti-IF steel or the steel sheet to which Ti is further added is preferably used for the applications where the heat resistance is particularly required.

Before describing the reasons for limitations on the steel components in the present invention, the characteristic features of each type of steel will be explained.

First, a Ti-containing steel has the characteristic feature in that its oxidation resistance is high. In those steels in which penetration type elements such as C, N, etc, are reduced as much as possible and C and N are fixed by adding Ti, Ti provides the effects of not only fixing C and N but also restricting oxidation of the base from very small uncoated portions and contributes to the improvement in the oxidation resistance. Cr, too, contributes to the oxidation resistance, and is preferably added in some cases. The present invention further improves the heat resistance and greatly contributes to the corrosion resistance, too.

Next, a high strength steel is the kind of the steel which literally has a high strength, and is characterized in that the drop of its strength is not great even at a high temperature. At the same time, because this steel is used at a high temperature, the steel must have a high oxidation resistance and for this reason, the C and N contents are reduced and Ti is added. The element that contributes to the high temperature strength is Mn, and a higher effect can be obtained by further adding Si, P and B. The present invention further improves the heat resistance and the corrosion resistance.

Next, a sol-N containing steel is a kind of steel which has high luster retention property at a high temperature. Generally, Al-coating has a beautiful metallic luster and has a wide range of applications as a heat-insulating sheet. However, when this steel is heated to a temperature not lower than 400° C., the Al-Si coating layer and base iron react with each other and result in the growth of the alloy layer. When the steel is heated for a long time, the alloy layer grows to the outermost surface layer, and the surface exhibits a black color of the alloy layer. Then, the function of the heat-insulating sheet is lost; hence, the addition of an element that restricts the growth of the alloy layer is necessary. When sol-N is added into the steel, this sol-N reacts with Al of the coating layer or the alloy layer, and a diffusion restriction layer of AlN is formed at the time of coating. This layer limits the reaction between the Al-Si coating layer and base iron, and the steel can retain the luster retention property up to a temperature of about 550° C. In order to leave sol-N, the amounts of the elements which react with N, such as Si, Al, etc, must be reduced as much as possible. The present invention further improves this luster retention property.

The kinds of the steels described so far all contain the steel components for obtaining the heat resistance, but Cr in the Cr-containing steel is the component directed primarily to obtaining the corrosion resistance. The greater the Cr content, the higher the corrosion resistance of the aluminum coated steel sheet increases. This effect is brought forth because Cr is diffused into the alloy layer and into the coating layer during coating. In this way, the corrosion resistance of both of the coating layer and the alloy layer can be improved. Furthermore, the heat resistance can be improved. In other words, the present invention can further improve the corrosion resistance as well as the heat resistance.

The kinds of the base steel sheets and their component compositions are concretely as follows.

1) First, as the Ti-IF steel sheet composition, the base sheet comprises the following components, in terms of the percentage by weight:

C: not greater than 0.02%,

Mn: 0.1 to 0.6%,

Ti: 0.1 to 0.5%,

N: 0.004%,

Al: 0.01 to 0.08%,

Cr: not greater than 1%, whenever necessary, and the balance of Fe and unavoidable impurities.

2) Next, as the high strength steel sheet composition, the base sheet comprises, in terms of the percentage by weight:

C: not greater than 0.02%,

Mn: 0.6 to 2.0%,

Ti: 0.1 to 0.5%,

N: 0.004%,

Al: 0.01 to 0.08%, at least one of the member selected from the group consisting of not greater than 1.5% of Si, not greater than 0.1% of P and not greater than 0.0003% of B, whenever necessary, and the balance of Fe and unavoidable impurities.

Further, as the sol-N containing steel sheet, a base sheet consisting of, in terms of wt %, C: not greater than 0.02%, SiO: not greater than 0.01%, N: 0.0015 to 0.0060%, Al: not greater than 0.01%, and the balance consisting of Fe and unavoidable impurities.

3) As the Cr containing steel sheet composition, a base steel sheet comprises, in terms of the percentage by weight:

C: not greater than 0.02%,

Mn: 0.1 to 1.5%,

Si: 0.2%,

Ti: 0.1 to 0.5%,

Cr: 1 to 9%,

N: 0.004%,

Al: 0.01 to 0.08%, the balance of Fe and unavoidable impurities.

4) As the stainless steel sheet composition, a steel sheet comprises, in terms of the percentage by weight:

C: not greater than 0.02%,

Mn: 0.1 to 1.5%,

Si: 0.2%,

Ti: 0.1 to 0.5%,

Cr: 10 to 25%,

N: 0.004%,

Al: 0.01 to 0.08%, the balance of Fe and unavoidable impurities.

Next, the reasons for limitations on the component composition of each base sheet will be described.

C: When the C content increases, grain boundary precipitation carbides generally increase and promote grain boundary corrosion of the steel. Therefore, the C amount is preferably small, and is limited to not greater than 0.02% in the present invention.

However, the C amount in the sol-N containing steel is not greater than 0.01%. For, C is the element that promotes the reaction between the Al-Si coating layer and Fe, and when the C amount exceeds this limit, the effect of restricting the alloying reaction cannot be obtained sufficiently, even when sol-N exists.

Mn: Mn is the element that contributes to the normal and high temperature strength of the steel sheet. Since the Mn amount in ordinary steel production methods cannot be reduced to below 0.1%, this amount is set as the lower limit. The upper limit value where machinability is of importance is about 0.6% but in order to secure the strength at a temperature not lower than 600° C., the Mn amount is at least 0.6% and is up to 2.0% as the upper limit value which takes the limit of machinability into consideration.

Ti: Ti is the element that reacts with C and N in the steel or with oxygen entering from outside, and improves the heat resistance of the aluminum coated steel sheet. To obtain this effect, the Ti amount must be at least about 20 times the sum of C and N, and the lower limit value is set to 0.1% as the necessary amount corresponding to the value of C and N that can be industrially reduced (C+N: 0.003 to 0.004%). On the other hand, the effect of Ti for improving the heat resistance reaches saturation if the amount is too great, and the upper limit is therefore set to 0.5%.

Cr: Cr, too, is an element that contributes to the improvement of the heat resistance, and is added to ordinary base sheets whenever necessary. However, its effect is not so great as that of Ti. On the other hand, when the Cr amount increases, the machinability of the steel sheet is deteriorated. Therefore, the upper limit is set to 1%.

However, the corrosion resistance can be drastically improved with an increase in the Cr amount. Therefore, Cr is added in an amount of from about 1 to about 9% for the applications where the corrosion resistance is particularly required. The improvement of the corrosion resistance is not sufficient if the amount of addition is less than 1%. When Cr is added in an amount exceeding 9%, on the other hand, Cr is likely to undergo surface concentration in the hot-dipped coating process because it is hard to reduce, and coating becomes difficult. However, coating can be applied to such a stainless type material by changing the coating method, and an extremely high corrosion resistance can be obtained by using a stainless steel containing about 10 to about 25% of Cr. The effect of the corrosion resistance is not sufficient when the Cr amount is less than 10%, and when the amount exceeds 25%, the effect of the corrosion resistance reaches saturation, and moreover, machinability of the steel sheet is lost.

Al: Al is added so as to adjust oxygen in the steel during the refining process of the molten steel. However, if the Al amount is too great, coating ability by Al is impeded and coating defects occur. Furthermore, machinability of the steel sheet drops. For these reasons, the lower limit and the upper limit are set to 0.01% and 0.08%, respectively.

However, the Al amount is not greater than 0.01% in the sol-N containing steel. When Al is present in the steel, it readily combines with N and forms AlN in the steel, so that sol-N that contributes to the luster retention property drops. For this reason, the amount is limited.

N: N is the element that impedes machinability of the steel and combines with Ti to thereby increase the Ti amount. Therefore, the N amount is preferably small and its upper limit is set to 0.004%.

However, the N amount is from 0.0015 to 0.0060% in the sol-N containing steel. If the amount is less than 0.0015%, sol-N necessary for the lust retention property cannot be obtained sufficiently, and sol-N in an excessive amount impedes machinability. Therefore, the upper limit is set to 0.0060%.

Further the following elements are added to the base sheets used in the present invention for various objects. First, as to the high strength:

Si: The amount of Si in the sol-N containing steel is limited to not greater than 0.2%. Si reacts with N and forms SiN and $Si_3N_4$ and consequently reduces sol-N.

In the case of the high strength steel, on the other hand, Si is added depending on the circumstances, and its amount is limited to not greater than 1.5%. In the case of the high strength steel containing large amounts of Mn, etc, Si improves the normal and high temperature strength. In this case, the greater the Si amount, the higher becomes the strength, but Si forms stable silicon oxides on the surface of the steel sheet in the coating process and impedes coating wettability. Therefore, its upper limit is set to 1.5%.

P: P improves the normal and high temperature strength in the same way as Si. The greater the amount of addition of P, the higher becomes the strength. However, when its amount exceeds 0.1%, weldability is lowered and cracks occur at spot weld nugget portions. Therefore, the upper limit value is set to 0.1%.

B: B precipitates as B compounds on the grain boundary, restricts the growth of the crystal grains to coarse grains at a high temperature and provides the effect of improving the high temperature strength. However, when the amount of addition is too great, quenching occurs due to the heat input at the time of welding, etc, and the steel is excessively hardened, so that ductility of the weld portion is deteriorated. Therefore, the upper limit value is set to 0.3%.

When a stainless steel containing 10 to 25% of Cr is used as the base sheet, at least one of Ni in the amount of 0.1 to 1%, Mo in the amount of 0.1 to 2% and Cu in the amount of 0.1 to 1% can be selectively added. When co-present with Cr, Ni and Mo provide the effect of restricting the progress of local corrosion, and Cu provides the effect of further improving the corrosion resistance.

Next, a chromate coat film and an organic coat film can be applied to the hot-dipped aluminum coated steel sheet in the present invention. As described above, the coat films include the 2-coat 2-bake type and the 1-coat 1-bake type. In the present invention, there is the case where primer coat and top coat are applied so as to obtain the corrosion resistance, and there is the case where 1-coat 1-bake of a transparent coat film is applied so as to obtain the beautiful appearance of aluminum coating. In the latter case, the thickness of the coat film is 1 to 15 μm, and its details and the reasons for limitation will be explained.

The chromate coat film in the present invention consists of chromium compounds as its principal component. However, it may contain silica for obtaining the corrosion resistance and phosphoric acid for whitening. The thickness is within the range of about 5 to about 40 mg/m$^2$ in terms of the deposition amount of Cr, and a stable rust-proofing effect can be obtained within this range.

As to resin coat film, a primer coat containing a rust-proofing pigment, etc, and a top coat film containing colorants, etc, and disposed on the primer coat, are generally applied. The primer coat may be any of an epoxy type, an acrylic type, a phenoxy type, a urethane type, etc, and the top coat may be any of an acrylic type, a polyurethane type, an alkyd type, a urethane type, a silicon polyester type, a silicon acrylic type, a fluorine type, etc. Strontium chromate, calcium chromate, zinc chromate, etc, can be used as the rust-proofing pigment.

In connection with the transparent resin coating film, the coated aluminum coated steel sheet is generally bent by rolling, etc, into various product shapes and in this instance, the aluminum coating layer is picked up, adheres to the shaping machine and is likely to deteriorate the corrosion resistance and surface quality of the steel sheet. To prevent this problem, resin coating is applied. Because the coating layer of the hot-dipped aluminum coated steel sheet is soft, however, scratching of the coating layer and the occurrence of red rust from this scratch are unavoidable under the severe machining condition where press work is carried out after machining into a complicated shape or rolling. Such scratching and the occurrence of the red rust from the scratching are observed more remarkably in the press work having a greater friction than in roll shaping. To prevent these problems, a transparent resin coating containing a wax is effective, and the transparent resin coating film is applied to a film thickness of 1 to 15 μm. Various resins such as an acrylic resin, a polyester resin, an alkyd resin, a silicone-modified resin, a urethane resin, a fluororesin, etc, are used as this transparent resin.

The reason for the limitation of the film thickness is as follows. If it is less than 1 μm, it becomes difficult to form a uniform coat film and if it exceeds 15 μm, on the other hand, the scratch prevention effect reaches saturation, and the production cost becomes higher.

As described above, the aluminum coated steel sheet according to the present invention has excellent corrosion resistance and excellent heat resistance, and the reason for such excellent properties is presumably because Mn and Cr concentrated near the interface between the alloy layer and the coating layer exert great influences. Particularly, propagation of the corrosion from the end face and the scratches is greatly restricted, and the high corrosion resistance and the high heat resistance are obtained at the scratches at the time of machining and at the spot weld portion. This effect is further increased by combining the specific composition of the base sheet used with the stipulation of the suitable range. Furthermore, the products having the chromate coating film and the transparent resin coating film have high creep restriction effects. Whenever necessary, zero spangle treatment of 150 to 300 g/m$^2$ may be applied to both surfaces in order to further improve appearance.

Such an aluminum coated steel sheet can be produced by the following production method.

A production method for a hot-dipped aluminum coated steel sheet excellent in both corrosion resistance and heat resistance, comprising:

forming a coating layer consisting of, in terms of percentage by weight:

Si: 2 to 15%,

Fe: not greater than 1.2%,

Mn: 0.005 to 0.6%,

Cr: 0.002 to 0.05%, and the balance consisting of Al and unavoidable impurities, wherein the sum of Sn and Zn in the impurities is not greater than 1%;

on the surface of a steel sheet; and forming an alloy layer between the steel sheet and the coating layer, having a thickness of not greater than 7 μm and having a mean composition consisting of, in terms of percentage by weight:

Fe: 20 to 50%,

Si: 3 to 20%,

Mn: 0.1 to 10%,

Cr: 0.05 to 1%, and the balance consisting of Al and unavoidable impurities;

by using a coating bath having a composition consisting of:

Si: 3 to 15%,

Fe: 0.5 to 3.5%,

Mn: 0.05 to 1.5%,

Cr: 0.01 to 0.2%, and the balance consisting of Al and unavoidable impurities, wherein the sum of Sn and Zn in the impurities is not greater than 1%; and wherein a deposition quantity of the coating layer is at least 60 g/m$^2$ on both surfaces, and heat-treatment is carried out in a region encompassed by the following coordinates A, B, C, D, E and F:

A: (5 seconds, 510° C.), D: (30 hours, 300° C.),

B: (1 minute, 530° C.), E: (1 minute, 300° C.),

C: (30 hours, 530° C.), F: (5 seconds, 450° C.).

Further, the present invention provides a production method for a hot-dipped aluminum coated steel sheet excellent in both corrosion resistance and heat resistance which comprises conducting coating by using the coating bath having the composition described above in such a manner as to contain the coating layer and the alloy layer each having the composition described above, and carrying out heat-treatment inside the region encompassed by the coordinates A, B, C, D, E and F.

This production method can drastically improve the corrosion resistance after machining in addition to the corrosion resistance and the heat resistance, which is brought forth by preventing the formation of cracks penetrating the coating layer as previously described.

The inventors of the present invention have made a novel observation for the method which makes the coating layer of the hot-dipped aluminum coated steel sheet more flexible and more quickly. When Mn and Cr are compositely added to the aluminum coating bath, the softening effect cannot be obtained immediately after coating but the present inventors have found out that the softening effect of the coating layer can be obtained more quickly and more strongly at the time of subsequent annealing. When these elements are added to the coating bath, these elements are not dispersed uniformly into the coating layer but are remarkably concentrated in the alloy layer. More concretely, the concentrations of these elements in the coating layer are about 1/5 to about 1/10 of the amounts added, and the rest are concentrated in the alloy layer. Therefore, the Mn and Cr concentrations in the coating layer become relatively small values, and they presumably become the precipitation sites of Fe and quicken the softening of the coating layer.

Next, the deposition quantity of coating and the annealing condition will be explained. As already described, when the annealed coating layer is softened, the propagation of the crack from the alloy layer to the surface is restricted at the time of bending and eventually, the cracks penetrating through the coating decrease. Accordingly, this effect depends on the deposition quantity of coating, and the smaller the deposition quantity, the smaller becomes the effect. In order to sufficiently soften the coating layer, the deposition quantity of at least 60 g/m$^2$ is necessary. When the deposition quantity is too great, adhesion of coating is likely to drop and a peculiar flow pattern is likely to be formed during the production. Therefore, a desirable deposition quantity is up to 300 g/m$^2$. The annealing condition depends on the precipitation rate of Fe into the coating layer. Therefore, the precipitation reaction rate of Fe must be controlled suitably, and the annealing temperature must be within the range of 300° to 530° C. as the temperature which can accomplish both the formation of the compact AlN layer and softening of the coating layer. The upper limit temperature of 530° C. is the critical value of the precipitation reaction rate of Fe, and the lower limit temperature of 300° C. is a temperature which is sufficient for the precipitation reaction rate of Fe and for imparting softening. Further, the annealing time is determined in association with the annealing temperature but softening is not possible in the annealing time of not longer than 5 seconds. Though the upper limit value of the annealing time is based on the premise of BAF annealing, it is set to 30 hours from the aspect of economy. By the way, annealing within a short time can be carried out near the upper limit temperature of 500° C., and annealing in an in-line furnace can be conducted sufficiently.

EXAMPLES

Example 1

Two kinds of steel sheets, that is, a 0.8 mm-thick Ti-IF steel and 0.8 mm-thick Al-k steel, each passed through ordinary hot rolling and cold rolling processes, were used as the raw sheets for coating, and hot-dipped aluminum coating was carried out in a refining furnace-reducing furnace type line. The components of each base sheet for plating are tabulated in Table 1. The adhered quantity of coating was adjusted by a gas wiping method to about 120 g/m$^2$ on both surfaces after coating, and the coated steel sheet was taken up after cooling. At this time, Si, Mn and Cr were added as coating bath components, and coating having excellent appearance could be obtained.

TABLE 1

Steel components of sample materials (wt %)

| | C | Si | Mn | P | S | Ti | Al |
|---|---|---|---|---|---|---|---|
| Ti-IF | 0.003 | 0.01 | 0.15 | 0.009 | 0.008 | 0.05 | 0.08 |
| Al-k | 0.032 | 0.02 | 0.14 | 0.011 | 0.009 | 0.00 | 0.03 |

Each of the aluminum coated steel sheets produced in this way was evaluated. The evaluation method is described below. Table 3 represents the production condition with the result of performance evaluation. When the Si amount in the bath was small (Comparative Example 1), the effect of restricting the alloy layer was low and consequently, the alloy layer grew. When the Mn and Cr amounts in the bath were too great (Comparative Examples 5 and 7), the bath temperature was high and the alloy layer grew, too, so that adhesion dropped. When the Si amount in the bath was too great (Comparative Example 2), or when the Sn and Zn amounts in the bath were too great (Comparative Example 9), the corrosion resistance dropped. When the Mn and Cr amounts in the bath were to small (Comparative Examples 3 and 8), all of the corrosion resistance the heat resistance and adhesion became inferior. When only Cr was added into the bath (Comparative Example 4), SST and corrosion resistance under outdoor exposure conditions could be improved, but the corrosion resistance under extremely severe conditions such as on the inner surface of an exhaust system was inferior, and adhesion was inferior, as well. When only Mn was added into the bath, on the contrary, both SST and outdoor exposure corrosion resistance were inferior.

(1) Analysis method of coating layer and alloy layer:

① Coating layer:

Only the coating layer was dissolved by electrolytic peel in 3% NaOH+1% $AlCl_3 \cdot 6H_2O$ and the solution was used as a solution for analyzing the coating layer composition. Each element was quantitatively determined.

② Alloy layer:

After the electrolytic peel described above, the alloy layer was peeled by 10% caustic soda to obtain an alloy layer composition analysis solution, and each element was quantitatively determined.

(2) Corrosion test:

The following three kinds of tests were carried out.

① Outdoor exposure test:

Each sample having a size of 50×200 mm was so fitted as to incline at 300 and to face the south, and was subjected to an outdoor exposure test for three years in an industrial district so as to measure a corrosion reduction quantity. The value of the corrosion reduction represented the value for both surfaces of coating.

② Brine spray test:

A brine spray test was carried out for each sample having a size of 70×150 mm for 30 days in accordance with JIS Z 2371, and the corrosion reduction quantity was measured. The value of the corrosion reduction quantity represented the value for one surface of coating.

③ Immersion test in solidified water of automobile exhaust system:

Each sample having a size of 70×150 mm was immersed in a solution represented in Table 2 for 30 minutes, and was dried at 70° C. for 30 minutes. This cycle was repeated 1,000 cycles, and the corrosion reduction quantity after the test was measured. The value was also the value for one surface of coating.

TABLE 2

| Composition of test solution (ppm) | | | | | |
|---|---|---|---|---|---|
| $Cl^-$ | $SO_4^{2-}$ | $SO_3^{2-}$ | $CO_3^{2-}$ | $NO_3^-$ | pH |
| 1000 | 3000 | 1000 | 1000 | 100 | 8 |

(3) Coating adhesion:

The following two kinds of tests were carried out.

① Reverse bend test:

Each sample having the shape shown in FIG. 1 was subjected to impact bending, and the coating peel condition at the bent portion was inspected and evaluated. The scale of evaluation is listed below:

evaluation point: reference

1: no abnormality

2: crack occurred in plating layer

3: dot-like peel of plating occurred

4: foil-like peel of plating occurred

5: peel of plating on entire surface

② Cup contraction test:

blank diameter: 50 mm, contraction depth: 10 mm, die shoulder radium: 2 mm, punch diameter: 33 mm.

Contraction was carried out under the condition described above, and the peel condition of coating on the side surface portion was inspected. The reference of evaluation was the same as that of the ① reverse bend test.

(4) Heat resistance test:

Each sample having a size of 100×100 mm was held in the atmosphere at 800° C. for 48 hours and was then cooled. This cycle was repeated five cycles, and the oxidation increment quantity after the test was measured.

TABLE 3

Test samples and performance evaluation results

| | No. | base sheet | coating bath composition (wt %) Si | Fe | Mn | Cr | Zn | Sn | bath temp. (°C.) |
|---|---|---|---|---|---|---|---|---|---|
| Example | 1 | Ti-IF | 3.7 | 2.2 | 0.32 | 0.04 | — | — | 680 |
| | 2 | Ti-IF | 6.0 | 2.3 | 0.32 | 0.04 | — | — | 670 |
| | 3 | Ti-IF | 9.4 | 2.3 | 0.30 | 0.04 | — | — | 655 |
| | 4 | Ti-IF | 14.2 | 2.3 | 0.31 | 0.04 | — | — | 655 |
| | 5 | Ti-IF | 9.4 | 2.3 | 0.06 | 0.04 | — | — | 655 |
| | 6 | Ti-IF | 9.4 | 2.3 | 0.17 | 0.04 | — | — | 655 |
| | 7 | Ti-IF | 9.4 | 2.3 | 0.29 | 0.04 | — | — | 655 |
| | 8 | Ti-IF | 9.5 | 2.2 | 0.61 | 0.05 | — | — | 655 |
| | 9 | Ti-IF | 9.5 | 2.2 | 0.93 | 0.04 | — | — | 680 |
| | 10 | Ti-IF | 9.4 | 2.3 | 1.43 | 0.05 | — | — | 705 |
| | 11 | Ti-IF | 9.4 | 2.3 | 0.31 | 0.03 | — | — | 655 |
| | 12 | Ti-IF | 9.5 | 2.3 | 0.31 | 0.08 | — | — | 655 |
| | 13 | Ti-IF | 9.5 | 2.3 | 0.31 | 0.17 | — | — | 685 |
| | 14 | Al-K | 9.4 | 2.3 | 0.30 | 0.04 | — | — | 655 |
| | 15 | Ti-IF | 9.5 | 2.3 | 0.31 | 0.03 | 0.02 | 0.02 | 655 |
| | 16 | Ti-IF | 9.5 | 2.3 | 0.30 | 0.03 | 0.45 | 0.01 | 655 |
| | 17 | Ti-IF | 9.4 | 2.3 | 0.31 | 0.03 | 0.02 | 0.44 | 655 |

| | No. | coating layer composition (wt %) Si | Fe | Mn | Cr | Zn | Sn | alloy layer mean composition (wt %) Si | Fe | Mn | Cr | Zn | Sn |
|---|---|---|---|---|---|---|---|---|---|---|---|---|---|
| Example | 1 | 2.8 | 0.48 | 0.04 | 0.005 | — | — | 5.5 | 36.9 | 1.3 | 0.13 | — | — |
| | 2 | 5.7 | 0.45 | 0.04 | 0.005 | — | — | 9.1 | 35.8 | 1.2 | 0.12 | — | — |
| | 3 | 9.0 | 0.44 | 0.04 | 0.005 | — | — | 11.2 | 37.5 | 1.5 | 0.12 | — | — |
| | 4 | 13.4 | 0.45 | 0.04 | 0.005 | — | — | 16.8 | 38.0 | 1.3 | 0.13 | — | — |
| | 5 | 9.0 | 0.44 | 0.01 | 0.005 | — | — | 11.5 | 37.8 | 0.3 | 0.13 | — | — |
| | 6 | 9.1 | 0.43 | 0.02 | 0.005 | — | — | 11.3 | 37.4 | 0.7 | 0.13 | — | — |
| | 7 | 9.0 | 0.40 | 0.04 | 0.005 | — | — | 11.9 | 36.4 | 1.1 | 0.14 | — | — |
| | 8 | 9.0 | 0.44 | 0.07 | 0.006 | — | — | 11.5 | 36.7 | 2.2 | 0.14 | — | — |
| | 9 | 9.0 | 0.45 | 0.13 | 0.006 | — | — | 11.6 | 35.8 | 3.5 | 0.12 | — | — |
| | 10 | 9.2 | 0.44 | 0.39 | 0.005 | — | — | 11.1 | 36.8 | 7.8 | 0.11 | — | — |
| | 11 | 9.0 | 0.43 | 0.05 | 0.004 | — | — | 11.8 | 37.6 | 1.2 | 0.10 | — | — |
| | 12 | 9.0 | 0.44 | 0.04 | 0.009 | — | — | 11.8 | 37.8 | 1.0 | 0.29 | — | — |
| | 13 | 9.0 | 0.44 | 0.04 | 0.02 | — | — | 11.2 | 38.1 | 1.3 | 0.41 | — | — |
| | 14 | 9.1 | 0.40 | 0.04 | 0.005 | — | — | 11.3 | 37.5 | 1.3 | 0.13 | — | — |
| | 15 | 9.0 | 0.45 | 0.05 | 0.004 | 0.02 | 0.02 | 11.4 | 36.9 | 1.2 | 0.10 | 0.02 | 0.02 |
| | 16 | 9.0 | 0.25 | 0.05 | 0.004 | 0.42 | 0.01 | 11.2 | 37.5 | 1.1 | 0.11 | 0.32 | 0.01 |
| | 17 | 9.0 | 0.22 | 0.05 | 0.004 | 0.02 | 0.44 | 11.6 | 37.3 | 1.2 | 0.12 | 0.02 | 0.05 |

TABLE 3-continued

| | No. | alloy layer thickness (μm) | corrosion resistance (g/m²) outdoor exposure | SST | exhaust system environment | coating adhesion reverse bend | cup contraction | heat resistance (g/m²) | overall evaluation |
|---|---|---|---|---|---|---|---|---|---|
| Example | 1 | 5.0 | 5.6 | 7.6 | 418 | 3 | 3 | 62 | ○ |
| | 2 | 3.2 | 6.5 | 8.1 | 430 | 2 | 2 | 54 | ◎ |
| | 3 | 2.8 | 6.7 | 8.7 | 425 | 1 | 1 | 45 | ◎ |
| | 4 | 2.8 | 7.0 | 8.5 | 433 | 1 | 1 | 43 | ◎ |
| | 5 | 2.5 | 5.9 | 8.8 | 691 | 2 | 2 | 57 | ◎ |
| | 6 | 2.6 | 6.5 | 8.5 | 489 | 2 | 1 | 51 | ◎ |
| | 7 | 2.8 | 6.0 | 8.1 | 411 | 1 | 1 | 44 | ◎ |
| | 8 | 2.5 | 5.8 | 7.5 | 365 | 1 | 1 | 37 | ◎ |
| | 9 | 3.4 | 5.3 | 7.5 | 349 | 2 | 2 | 30 | ◎ |
| | 10 | 5.2 | 5.2 | 7.1 | 266 | 3 | 3 | 25 | ○ |
| | 11 | 2.8 | 6.5 | 10.1 | 428 | 2 | 1 | 47 | ◎ |
| | 12 | 2.8 | 6.1 | 7.9 | 423 | 1 | 1 | 43 | ◎ |
| | 13 | 3.8 | 5.0 | 5.4 | 410 | 3 | 3 | 43 | ○ |
| | 14 | 2.7 | 6.6 | 8.8 | 423 | 1 | 1 | 83 | ○ |
| | 15 | 2.8 | 6.6 | 9.0 | 409 | 1 | 1 | 45 | ◎ |
| | 16 | 2.7 | 7.9 | 10.3 | 512 | 1 | 1 | 43 | ◎ |
| | 17 | 2.8 | 8.2 | 10.9 | 497 | 1 | 1 | 46 | ◎ |

| | No. | base sheet | coating bath composition (wt %) Si | Fe | Mn | Cr | Zn | Sn | bath temp. (°C.) |
|---|---|---|---|---|---|---|---|---|---|
| Comp. Example | 1 | Ti-IF | 2.2 | 2.3 | 0.31 | 0.04 | — | — | 690 |
| | 2 | Ti-IF | 15.8 | 2.3 | 0.30 | 0.05 | — | — | 680 |
| | 3 | Ti-IF | 9.4 | 2.3 | 0.02 | — | — | — | 655 |
| | 4 | Ti-IF | 9.4 | 2.2 | 0.03 | 0.05 | — | — | 655 |
| | 5 | Ti-IF | 9.5 | 2.2 | 1.66 | 0.04 | — | — | 735 |
| | 6 | Ti-IF | 9.5 | 2.3 | 0.30 | — | — | — | 655 |
| | 7 | Ti-IF | 9.5 | 2.3 | 0.30 | 0.23 | — | — | 740 |
| | 8 | Al-K | 9.4 | 2.3 | 0.02 | — | — | — | 655 |
| | 9 | Ti-IF | 9.4 | 2.3 | 0.31 | 0.03 | 0.61 | 0.58 | 655 |

| | No. | coating layer composition (wt %) Si | Fe | Mn | Cr | Zn | Sn | alloy layer mean composition (wt %) Si | Fe | Mn | Cr | Zn | Sn |
|---|---|---|---|---|---|---|---|---|---|---|---|---|---|
| Comp. Example | 1 | 2.0 | 0.52 | 0.04 | 0.005 | — | — | 3.8 | 37.9 | 1.5 | 0.13 | — | — |
| | 2 | 15.3 | 0.45 | 0.04 | 0.006 | — | — | 20.9 | 32.7 | 1.4 | 0.13 | — | — |
| | 3 | 9.1 | 0.44 | 0.02 | — | — | — | 11.4 | 36.5 | 0.05 | — | — | — |
| | 4 | 9.0 | 0.44 | 0.003 | 0.005 | — | — | 11.1 | 38.9 | 0.1 | 0.14 | — | — |
| | 5 | 9.1 | 0.45 | 0.15 | 0.005 | — | — | 11.9 | 35.0 | 4.6 | 0.13 | — | — |
| | 6 | 9.0 | 0.42 | 0.23 | — | — | — | 11.5 | 37.6 | 0.5 | 0.01 | — | — |
| | 7 | 9.1 | 0.46 | 0.04 | 0.02 | — | — | 11.5 | 36.6 | 1.3 | 0.61 | — | — |
| | 8 | 9.1 | 0.45 | 0.01 | — | — | — | 11.2 | 36.8 | 0.02 | — | — | — |
| | 9 | 9.0 | 0.16 | 0.05 | 0.004 | 0.60 | 0.57 | 11.0 | 37.3 | 1.4 | 0.10 | 0.39 | 0.02 |

| | No. | alloy layer thickness (μm) | corrosion resistance (g/m²) outdoor exposure | SST | exhaust system environment | coating adhesion reverse bend | cup contraction | heat resistance (g/m²) | overall evaluation |
|---|---|---|---|---|---|---|---|---|---|
| Comp. Example | 1 | 8.5 | 5.2 | 7.3 | 431 | 5 | 5 | 78 | x |
| | 2 | 3.4 | 10.1 | 13.8 | 488 | 2 | 1 | 45 | Δ |
| | 3 | 2.5 | 9.2 | 20.5 | 1179 | 3 | 2 | 76 | x |
| | 4 | 2.5 | 6.8 | 8.8 | 974 | 3 | 3 | 68 | x |
| | 5 | 7.5 | 5.4 | 7.3 | 342 | 5 | 4 | 28 | x |
| | 6 | 2.6 | 8.9 | 19.3 | 451 | 2 | 2 | 51 | x |
| | 7 | 7.8 | 4.3 | 4.8 | 415 | 5 | 4 | 43 | x |
| | 8 | 2.5 | 9.1 | 21.0 | 1211 | 3 | 2 | 152 | x |
| | 9 | 2.7 | 12.2 | 24.7 | 620 | 1 | 1 | 46 | x |

Remarks:
1) The underline represents the range outside the range of the present invention
2) overall evaluation: ◎: excellent ○: fair x: inferior

Example 2

Hot-dipped aluminum coating was carried out by using, as the base sheet, each of several kinds of steels having the compositions tabulated in Table 5, having a thickness of 0.8 mm and produced through ordinary hot rolling and cold rolling, in a refining furnace-reducing furnace type line. The adhesion quantity of coating was adjusted to about 120 g/m² on both surfaces, after coating by a gas wiping method, and after being cooled, each steel sheet was taken up. In this instance, Si, Mn and Cr were added as the coating bath components, and coating having good appearance could be made.

Each of the resulting aluminum coated steel sheets was evaluated. The evaluation method is described below. The production condition of the evaluation results are tabulated in Tables 4 and 5.

TABLE 4

| | steel sheet composition and content (wt %) | | | | | | | | | | | coating bath composition (wt %) | | | | | |
|---|---|---|---|---|---|---|---|---|---|---|---|---|---|---|---|---|---|
| No. | C | Si | Mn | Ti | Al | N | Cr | B | Cu | Mo | Ni | Si | Fe | Mn | Cr | Zn | Sn |
| 1 | 0.005 | 0.01 | 0.24 | 0.22 | 0.06 | 0.0030 | | | | | | 9.4 | 2.0 | 0.30 | 0.04 | | |
| 2 | 0.003 | 0.01 | 0.25 | 0.13 | 0.05 | 0.0033 | 0.01 | | | | | 9.5 | 2.0 | 0.30 | 0.03 | 0.35 | 0.41 |
| 3 | 0.005 | 0.01 | 0.22 | 0.33 | 0.05 | 0.0035 | 0.29 | | | | | 9.4 | 2.0 | 0.30 | 0.04 | | |
| 4 | 0.002 | 0.21 | 0.84 | 0.15 | 0.04 | 0.0022 | | | | | | 6.0 | 2.0 | 0.30 | 0.04 | | |
| 5 | 0.003 | 0.20 | 0.71 | 0.15 | 0.04 | 0.0029 | | 0.0025 | | | | 9.3 | 2.0 | 0.30 | 0.04 | | |
| 6 | 0.004 | 0.01 | 0.29 | 0.15 | 0.005 | 0.0041 | | | | | | 9.5 | 2.0 | 0.30 | 0.04 | | |
| 7 | 0.005 | 0.01 | 0.24 | 0.15 | 0.06 | 0.0030 | 5.04 | | | | | 9.4 | 2.0 | 0.29 | 0.04 | | |
| 8 | 0.005 | 0.01 | 0.25 | 0.15 | 0.05 | 0.0030 | 3.00 | | 0.31 | | | 9.4 | 2.0 | 0.31 | 0.04 | | |
| 9 | 0.005 | 0.01 | 0.24 | 0.13 | 0.05 | 0.003 | 16.34 | | | | | 9.4 | 1.9 | 0.93 | 0.04 | | |
| 10 | 0.005 | 0.01 | 0.25 | 0.14 | 0.06 | 0.003 | 17.07 | | | 1.52 | | 9.5 | 2.1 | 0.31 | 0.04 | | |
| 11 | 0.003 | 0.01 | 0.23 | 0.15 | 0.05 | 0.003 | 17.08 | | | 1.51 | 0.51 | 9.5 | 2.0 | 0.31 | 0.04 | | |

| | bath temp. | coating layer composition (wt %) | | | | | | alloy layer mean composition | | | | | | alloy layer thickness |
|---|---|---|---|---|---|---|---|---|---|---|---|---|---|---|
| No. | °C. | Si | Fe | Mn | Cr | Zn | Sn | Si | Fe | Mn | Cr | Zn | Sn | μm |
| 1 | 655 | 9.0 | 0.44 | 0.04 | 0.005 | | | 11.2 | 37.5 | 1.5 | 0.12 | | | 2.8 |
| 2 | 655 | 9.0 | 0.25 | 0.05 | 0.004 | 0.32 | 0.40 | 11.2 | 37.5 | 1.1 | 0.11 | 0.35 | 0.03 | 2.8 |
| 3 | 655 | 9.0 | 0.44 | 0.04 | 0.005 | | | 11.2 | 37.5 | 1.5 | 0.12 | | | 2.8 |
| 4 | 670 | 5.7 | 0.44 | 0.04 | 0.005 | 0.32 | 0.40 | 9.1 | 36.0 | 1.2 | 0.12 | 0.35 | 0.03 | 3.3 |
| 5 | 655 | 9.0 | 0.45 | 0.04 | 0.005 | | | 11.3 | 36.9 | 1.5 | 0.12 | | | 2.8 |
| 6 | 655 | 9.0 | 0.44 | 0.04 | 0.005 | | | 11.3 | 37.7 | 1.6 | 0.12 | | | 2.8 |
| 7 | 655 | 9.0 | 0.40 | 0.04 | 0.03 | | | 11.9 | 36.4 | 1.1 | 1.8 | | | 2.8 |
| 8 | 655 | 9.1 | 0.44 | 0.04 | 0.05 | | | 11.2 | 37.3 | 1.5 | 1.1 | | | 2.8 |
| 9 | 690 | 9.0 | 0.44 | 0.13 | 0.09 | | | 11.6 | 35.8 | 3.5 | 3.5 | | | 3.6 |
| 10 | 655 | 9.0 | 0.43 | 0.04 | 0.09 | | | 11.3 | 37.9 | 1.5 | 3.5 | | | 2.5 |
| 11 | 655 | 9.0 | 0.43 | 0.04 | 0.09 | | | 11.2 | 37.6 | 1.5 | 3.5 | | | 2.5 |

TABLE 5

| | corrosion resistance ($g/m^2$) | | coating adhesion | | press | weld portion Ericssen | high temp. tensile test (600° C.) | | luster retention | | | heat | |
|---|---|---|---|---|---|---|---|---|---|---|---|---|---|
| No. | SST | exhaust environment | reverse bend | cup contraction | mold-ability | test (mm) | strength ($Kg/mm^2$) | elongation (%) | 550° C. | 600° C. | 650° C. | resistance ($g/m^2$) | overall evaluation |
| 1 | 8.3 | 425 | 1 | 1 | | | | | | | | 30 | ◎ |
| 2 | 15.3 | 614 | 1 | 1 | | | | | | | | 28 | ◎ |
| 3 | 8.7 | 422 | 1 | 1 | | | | | | | | 23 | ◎ |
| 4 | 8.2 | 427 | 2 | 2 | ○ | 11.2 | 18.1 | 37.2 | | | | 38 | ○ |
| 5 | 8.5 | 435 | 1 | 1 | ○ | 11.1 | 20.3 | 37.9 | | | | 30 | ◎ |
| 6 | 8.3 | 425 | 1 | 1 | ○ | | | | ○ | ○ | x | | ◎ |
| 7 | 4.1 | 268 | 1 | 1 | | | | | | | | 23 | ◎ |
| 8 | 5.9 | 215 | 1 | 1 | | | | | | | | 24 | ◎ |
| 9 | 4.2 | 100 | 1 | 1 | ○ | | | | | | | 17 | ◎ |
| 10 | 4.2 | 128 | 1 | 1 | ○ | | | | | | | 17 | ◎ |
| 11 | 4.0 | 128 | 1 | 1 | ○ | | | | | | | 16 | ◎ |

(1) Analysis method of coating layer and alloy layer composition:

① Coating layer:

Only the coating layer was dissolved by an electrolytic peel in 3% NaOH+1% $AlCl_3 \cdot 4H_2O$ and the solution was used as a solution for analyzing the coating layer composition. Each element was quantitatively determined.

② Alloy layer:

After an electrolytic peel as described above, the alloy layer was peeled by 10% caustic soda to obtain an alloy layer composition analysis solution, and each element was quantitatively determined.

(2) Corrosion test:

The corrosion test was carried out in the same way as in Example 1.

(3) Coating adhesion:

The coating adhesion test was carried out in the same way as in Example 1.

(4) Heat resistance test:

The heat resistance test was carried out in the same way as in Example 1.

(5) Luster retention test:

Samples having a size of 50×50 mm were retained in the atmosphere at 550° C., 600° C. and 650° C. for 200 hours, respectively, and their appearance after heating was judged by eye. The reference for judgement was as follows:

○: silver white color was retained

Δ: blackening occurred slightly x: blackening occurred on entire surface (6) Press moldability:

Each sample sheet was molded into a diameter of 80 mm and a depth of 40 mm, and moldability was evaluated depending on the degree of the occurrence of cracks.

○: no crack x: crack occurred

Example 3

Hot-dipped aluminum coating was carried out by using, as the base sheet, each of several kinds of steels having the compositions tabulated in Table 1, having a thickness of 0.8 mm and produced through ordinary hot rolling and cold rolling, in a refining furnace-reducing furnace type line. The adhesion quantity of coating was adjusted to about 200 g/m$^2$ on both surfaces after coating by a gas wiping method, and after cooling, each steel sheet was taken up. In this instance, Si, Mn and Cr were added as the coating bath components, and coating was carried out. Coating having a good appearance could be made.

Roll coating was applied to each of the resulting hot-dipped aluminum coated steel sheets by using a solution consisting of $CrO_3$: 30 g/l, $H_3PO_4$: 10 g/l and $SiO_2$: 10 g/l, and each sheet was dried at 100° C. Next, chromate processing was applied to an adhesion quantity of 15 mg/m$^2$. A primer coat prepared by adding 20%, in terms of a dry weight ratio, of strontium chromate rust-proofing pigment to an epoxy or acrylic resin was coated into a dry film thickness of 10 μm, and baking was done at a sheet temperature of 200° C. for 60 seconds. Further, a silicone polyester type or a fluorine type coating was applied on the primer to a dry film thickness of 20 μm, and baking was done at a sheet temperature of 240° C. for 60 seconds. After the production was completed, each sample sheet was evaluated under several conditions. The evaluation method is listed below. The production condition and the evaluation results are together tabulated in Tables 2 and 3. When Mn and Cr were compositely added into the bath, both corrosion resistance and adhesion could be improved. When the amount of Mn or Cr was too small, the corrosion resistance was not sufficient, and when the amount of Mn or Cr was too great, the bath temperature had to be raised. Consequently, the alloy layer grew, and adhesion was impeded. When the sum of Zn and Sn was too great, the corrosion resistance was impeded.

TABLE 6

Steel components of sample materials (wt %)

| | C | Si | Mn | P | S | Ti | Al | N | Cr |
|---|---|---|---|---|---|---|---|---|---|
| A | 0.032 | 0.02 | 0.14 | 0.011 | 0.009 | 0.00 | 0.03 | 0.002 | — |
| B | 0.005 | 0.01 | 0.15 | 0.009 | 0.008 | 0.04 | 0.08 | 0.003 | — |
| C | 0.003 | 0.01 | 0.25 | 0.009 | 0.008 | 0.13 | 0.05 | 0.003 | 10.91 |
| D | 0.005 | 0.01 | 0.24 | 0.010 | 0.008 | 0.15 | 0.06 | 0.003 | 16.34 |

TABLE 7

Detail of sample materials

| | No. | base sheet | coating bath composition (wt %) Si | Fe | Mn | Cr | Zn | Sn | bath temp. (°C.) |
|---|---|---|---|---|---|---|---|---|---|
| Example | 1 | A | 6.0 | 2.0 | 0.32 | 0.04 | — | — | 670 |
| | 2 | A | 9.4 | 2.0 | 0.10 | 0.04 | — | — | 655 |
| | 3 | A | 9.4 | 2.0 | 0.29 | 0.04 | — | — | 655 |
| | 4 | A | 9.5 | 1.9 | 0.61 | 0.05 | — | — | 655 |
| | 5 | A | 9.5 | 1.9 | 0.93 | 0.04 | — | — | 690 |
| | 6 | A | 9.4 | 2.0 | 0.31 | 0.06 | — | — | 655 |
| | 7 | A | 9.5 | 2.0 | 0.31 | 0.13 | — | — | 685 |
| | 8 | A | 9.5 | 2.0 | 0.30 | 0.03 | 0.35 | 0.41 | 655 |
| | 9 | B | 9.4 | 2.0 | 0.30 | 0.04 | — | — | 655 |
| | 10 | C | 9.4 | 2.0 | 0.30 | 0.04 | — | — | 655 |
| | 11 | D | 9.4 | 2.0 | 0.30 | 0.04 | — | — | 655 |
| | 12 | A | 9.4 | 2.0 | 0.29 | 0.04 | — | — | 655 |
| | 13 | A | 9.4 | 2.0 | 0.29 | 0.04 | — | — | 655 |
| Comp. Example | 1 | A | 9.4 | 2.0 | 0.01 | — | — | — | 655 |
| | 2 | A | 9.5 | 1.9 | 1.12 | 0.04 | — | — | 733 |
| | 3 | A | 9.5 | 2.0 | 0.30 | 0.01 | — | — | 654 |
| | 4 | A | 9.5 | 2.0 | 0.30 | 0.18 | — | — | 718 |
| | 5 | A | 9.4 | 2.0 | 0.31 | 0.03 | 0.61 | 0.58 | 655 |

| | No. | coating layer composition (wt %) Si | Fe | Mn | Cr | Zn | Sn | alloy layer mean composition (wt %) Si | Fe | Mn | Cr | Zn | Sn |
|---|---|---|---|---|---|---|---|---|---|---|---|---|---|
| Example | 1 | 5.7 | 0.45 | 0.04 | 0.005 | — | — | 9.1 | 35.8 | 1.2 | 0.12 | — | — |
| | 2 | 9.0 | 0.44 | 0.01 | 0.005 | — | — | 11.5 | 37.8 | 0.3 | 0.13 | — | — |
| | 3 | 9.0 | 0.40 | 0.04 | 0.005 | — | — | 11.9 | 36.4 | 1.1 | 0.14 | — | — |
| | 4 | 9.0 | 0.44 | 0.07 | 0.006 | — | — | 11.5 | 36.7 | 2.2 | 0.14 | — | — |
| | 5 | 9.0 | 0.45 | 0.13 | 0.006 | — | — | 11.6 | 35.8 | 3.5 | 0.12 | — | — |
| | 6 | 9.0 | 0.43 | 0.05 | 0.009 | — | — | 11.8 | 37.6 | 1.2 | 0.20 | — | — |
| | 7 | 9.0 | 0.44 | 0.04 | 0.02 | — | — | 11.2 | 38.1 | 1.3 | 0.41 | — | — |
| | 8 | 9.0 | 0.25 | 0.05 | 0.004 | 0.32 | 0.40 | 11.2 | 37.5 | 1.1 | 0.11 | 0.35 | 0.03 |
| | 9 | 9.0 | 0.44 | 0.04 | 0.005 | — | — | 11.2 | 37.5 | 1.5 | 0.12 | — | — |
| | 10 | 9.0 | 0.44 | 0.04 | 0.11 | — | — | 11.2 | 37.5 | 1.5 | 2.9 | — | — |
| | 11 | 9.0 | 0.44 | 0.04 | 0.13 | — | — | 11.2 | 37.5 | 1.5 | 3.3 | — | — |
| | 12 | 9.0 | 0.40 | 0.04 | 0.005 | — | — | 11.9 | 36.4 | 1.1 | 0.13 | — | — |

TABLE 7-continued

| | | | | | | | | | | | | | |
|---|---|---|---|---|---|---|---|---|---|---|---|---|---|
| | 13 | 9.0 | 0.40 | 0.04 | 0.006 | — | — | 11.9 | 36.4 | 1.1 | 0.13 | — | — |
| Comp. | 1 | 9.1 | 0.44 | 0.01 | — | — | — | 11.4 | 36.5 | — | — | — | — |
| Example | 2 | 9.1 | 0.45 | 0.15 | 0.005 | — | — | 11.9 | 35.0 | 4.6 | 0.13 | — | — |
| | 3 | 9.0 | 0.42 | 0.23 | 0.001 | — | — | 11.5 | 37.6 | 0.5 | 0.04 | — | — |
| | 4 | 9.1 | 0.46 | 0.04 | 0.02 | — | — | 11.5 | 36.6 | 1.3 | 0.61 | — | — |
| | 5 | 9.0 | 0.16 | 0.05 | 0.004 | 0.60 | 0.57 | 11.0 | 37.3 | 1.4 | 0.10 | 0.39 | 0.00 |

(remarks)
underline represents the condition outside the range of the present invention

TABLE 8

Detail of sample materials and performance evaluation result

| | No. | alloy layer thickness (μm) | primer coat resin | top coat resin | corrosion resistance (mm) exposure | corrosion resistance (mm) SST | adhesion RBA | adhesion CDA | overall evaluation |
|---|---|---|---|---|---|---|---|---|---|
| Example | 1 | 3.2 | epoxy | silicone | 0.5 | 3 | 2 | 2 | ○ |
| | 2 | 2.5 | " | polyester | 0.7 | 4 | 2 | 2 | ○ |
| | 3 | 2.8 | " | | 0.5 | 3 | 1 | 1 | ⊙ |
| | 4 | 3.0 | " | | 0.4 | 2 | 1 | 1 | ⊙ |
| | 5 | 3.9 | " | | 0.4 | 2 | 2 | 2 | ○ |
| | 6 | 2.8 | " | | 0.6 | 3 | 2 | 1 | ⊙ |
| | 7 | 3.8 | " | | 0.6 | 3 | 3 | 2 | ○ |
| | 8 | 2.7 | " | | 0.8 | 4 | 1 | 1 | ○ |
| | 9 | 2.8 | " | | 0.5 | 3 | 1 | 1 | ⊙ |
| | 10 | 2.8 | " | | 0.3 | 2 | 1 | 1 | ⊙ |
| | 11 | 2.8 | " | | 0.3 | 2 | 1 | 1 | ⊙ |
| | 12 | 2.8 | acrylic | | 0.6 | 3 | 2 | 1 | ⊙ |
| | 13 | 2.8 | acrylic | F | 0.3 | 1 | 2 | 1 | ⊙ |
| Comp. | 1 | 2.5 | epoxy | silicone | 1.5 | 8 | 3 | 2 | x |
| Example | 2 | 5.4 | " | polyester | 0.5 | 2 | 4 | 4 | x |
| | 3 | 2.6 | " | | 1.2 | 6 | 2 | 2 | x |
| | 4 | 5.6 | " | | 0.7 | 3 | 4 | 4 | |
| | 5 | 2.7 | " | | 1.4 | 6 | 1 | 1 | x |

Remarks:
1) RBA: reverse bend CDA: cup contraction
2) overall evaluation:
⊙: excellent, ○: fair, x: inferior
3) underline represents the condition outside the range of the invention (1) Analysis method coating layer and alloy layer composition:

The analysis was carried out in the same way as in Example 2.

(2) Corrosion test:

The following two kinds of tests were carried out.

① Outdoor exposure test:

Each sample having a size of 50×200 mm was inclined at 30° in such a manner as to face the south, and was subjected to an outdoor exposure test for two years in an industrial district so as to measure the corrosion progress width from the end face (the edge creep width).

② Brine spray test:

A brine spray test was carried out for each sample having a size of 70×150 mm for 30 days in accordance with JIS 22371 so as to measure the corrosion progress width from the end face (the edge creep width).

Example 4

The hot-dipped aluminum coated steel sheets of No. 3 of the present invention and Comparative Example 1 set forth in Tables 7 and 8 of Example 3 were used as the base sheets for coating. The bath components and the components of the coating layer and the alloy layer are tabulated in Table 9.

Coating base sheet: A in Table 6 (Al-k steel)

The chromate processing was applied to this hot-dipped aluminum coated steel sheet under the same condition as in Example 3. Next, an acrylic type transparent resin coat ("Coil Coat 289"), a product of Kawakami Toso K.K., was applied, and was baked and dried at 200° C. In this case, the coat film thickness was adjusted to 0.5 to 20 μm. A resin coat prepared by adding 0.05 to 3% of powdery polyethylene wax to this transparent resin coat was also applied, and was similarly baked and dried at 200° C. The coat film thickness was similarly adjusted to 0.5 to 20 μm. These samples were evaluated after production. Among the evaluation items, the corrosion resistance, moldability and scratch resistance were evaluated in the same way as in Example 1. The evaluation methods of other items are presented below. The production condition and the evaluation result are tabulated in Tables 10 and 11. When extreme moldability was not particularly required, it was not necessary to add the wax to the coat, and in this case, the value of a critical contraction ratio was not large. When the film thickness was too small, sufficient moldability and scratch resistance could not be obtained. Further, the corrosion resistance was not sufficient for those coating compositions to which Mn and Cr were not added.

As described above, the addition of the wax to the coat was effective for the applications where severe machining was required, and moldability and scratch resistance could be acquired using a thin film. However, when the amount of the wax was too small, its contribution to moldability and scratch resistance was small. A sufficient corrosion resistance could not be obtained when Mn and Cr were not added to the coating composition, as already described. In Example No. 38 of the present invention, moldability (critical contraction value) was 1.8, but this value was considerably insufficient because the object of the addition of the wax was to obtain excellent moldability.

TABLE 9

Components of coating bath, coating layer and alloy layer

| | coating bath composition (wt %) | | | | bath temp. | coating layer composition (wt %) | | | | alloy layer composition (wt %) | | | | alloy layer thickness |
|---|---|---|---|---|---|---|---|---|---|---|---|---|---|---|
| | Si | Fe | Mn | Cr | (°C.) | Si | Fe | Mn | Cr | Si | Fe | Mn | Cr | (μm) |
| Example 3 | 9.4 | 2.0 | 0.29 | 0.04 | 655 | 9.0 | 0.40 | 0.04 | 0.005 | 11.9 | 36.4 | 1.1 | 0.14 | 2.8 |
| Comp. Example 1 | 9.4 | 2.0 | 0.01 | — | 655 | 9.1 | 0.44 | 0.01 | — | 11.4 | 36.5 | — | — | 2.5 |

TABLE 10

Production condition and evaluation result

| | No. | coating base sheet | resin type | film thickness (μm) | kind of wax | amount of wax (%) | corrosion resistance (mm) SST | corrosion resistance (mm) exposure | mold-ability | scratch | overall evaluation |
|---|---|---|---|---|---|---|---|---|---|---|---|
| Example | 21 | Example 3 | acrylic | 2 | no | — | 10 | 0.8 | 1.7 | 0.41 | ○ |
| | 22 | " | " | 5 | addition | — | 8 | 0.6 | 1.8 | 0.40 | ○ |
| | 23 | " | " | 10 | | — | 7 | 0.5 | 1.9 | 0.38 | ○ |
| | 24 | " | " | 20 | | — | 5 | 0.5 | 2.0 | 0.38 | ◎ |
| | 25 | " | polyester | 5 | | — | 8 | 0.6 | 2.0 | 0.56 | ◎ |
| Comp. Example | 21 | Comp. Example 1 | acrylic | 0.5 | no | — | 17 | 0.9 | 1.5 | x | x |
| | 22 | Comp. Example 1 | " | 5 | addition | — | 25 | 1.8 | 1.8 | 0.40 | x |

TABLE 11

Production condition and evaluation result

| | No. | coating base sheet | resin type | film thickness (μm) | kind of wax | amount of wax (%) | corrosion resistance (mm) SST | corrosion resistance (mm) exposure | mold-ability | scratch | overall evaluation |
|---|---|---|---|---|---|---|---|---|---|---|---|
| Example | 31 | Example 3 | acrylic | 5 | polyethylene | 0.1 | 8 | 0.6 | 2.0 | 0.36 | ◎ |
| | 32 | " | | " | " | 0.3 | 8 | 0.5 | 2.1 | 0.35 | ◎ |
| | 33 | " | | " | " | 0.6 | 8 | 0.5 | 2.2 | 0.36 | ◎ |
| | 34 | " | | " | " | 1 | 8 | 0.6 | 2.2 | 0.36 | ◎ |
| | 35 | " | | " | " | 2 | 8 | 0.6 | 2.2 | 0.36 | ◎ |
| | 36 | " | | " | " | 3 | 8 | 0.6 | 2.2 | 0.36 | ◎ |
| | 37 | " | | " | polypropylene | 1 | 8 | 0.6 | 2.2 | 0.35 | ◎ |
| | 38 | " | | " | polyethylene | 0.01 | 8 | 0.5 | 1.8 | 0.42 | ○ |
| Comp. Example | 31 | Comp. Example 1 | " | 5 | " | 1 | 25 | 1.8 | 2.2 | 0.36 | x |

(1) Modability test:

A contraction test was carried out by using a universal moldability tester at a wrinkle support pressure of 500 kg and a punch diameter of 50 mm and by changing a blank diameter. A maximum blank diameter at which the occurrence of cracking of each testpiece did not occur was determined, and the ratio of this blank diameter to the punch diameter was used as a critical contraction ratio. This ratio was evaluated.

(2) Scratch resistance test:

A load of 1 kg was applied to a steel ball having a diameter of 10 mm by using a Bauden kinetic frictional coefficient tester, and the same position was repeatedly measured 100 times. The scratch resistance was evaluated by the value of the 100th measurement. Those samples which underwent buckling before the 100th measurement and could not be measured were represented by x.

Example 5

Hot-dipped aluminum coating was carried out by using, as the base sheet, each of several kinds of steels having the compositions tabulated in Table 12, having a thickness of 0.8 mm and produced through ordinary hot rolling and cold rolling, in a refining furnace-reducing furnace type line. The adhesion quantity of coating was adjusted to about 40 to 300 g/m$^2$ on both surfaces after coating by a gas wiping method, and after being cooled, each steel sheet was taken up. En this instance, Si, Mn and Cr were added as the coating bath components, and coating was carried out. Coating having a good appearance could be produced.

Organic resin coating was applied to some of the aluminum coated steel sheets. First, roll coating was carried out by using a solution consisting of $CrO_3$: 30 g/l, $H_3PO_4$: 10 g/l and $SiO_2$: 10 g/l, and drying was done at 100° C. Next, chromate processing was carried out to an adhesion quantity of 15 mg/m$^2$, and then coating was conducted. The coating systems were 2-coat type and 1-coat type transparent resin. The coating conditions are tabulated in Table 13.

Various properties of these samples were evaluated by the following evaluation method after production. The production conditions and the evaluation results are tabulated in Table 14.

TABLE 12

| | Components of sample steels (wt %) | | | | | | | |
|---|---|---|---|---|---|---|---|---|
| kind of steel | C | Si | Mn | P | S | Ti | Al | N |
| Al-k | 0.032 | 0.02 | 0.14 | 0.011 | 0.009 | 0.00 | 0.03 | 0.002 |
| Ti-IF | 0.005 | 0.01 | 0.15 | 0.009 | 0.008 | 0.04 | 0.08 | 0.003 |

TABLE 13

| | Coating condition | | | | | | | | | | |
|---|---|---|---|---|---|---|---|---|---|---|---|
| | top coat | | | | primer coat | | | | | | |
| | resin type | film thickness μm | sheet temp. °C. | time sec | resin type | film thickness μm | rust-proofing pigment | amount (dry weight ratio) % | sheet temp. °C. | time sec |
| 1-coat | acrylic | 5 | 200 | 40 | — | — | — | — | — | — |
| 2-coat | silicone polyester | 20 | 240 | 60 | epoxy | 10 | Sr chromate | 20 | 200 | 60 |

TABLE 14

Detail of sample steels and evaluation result

| | No. | base sheet | coating bath component (wt %) Si | Fe | Mn | Cr | Zn | Sn | bath temp. (°C.) | adhesion q'ty (g/m²) | annealing temp. (°C.) | time | coat | adhesion RBA | CDA | 1-bend corrosion resistance | SST corrosion resistance | overall evaluation |
|---|---|---|---|---|---|---|---|---|---|---|---|---|---|---|---|---|---|---|
| Example | 1 | Al-k | 6.0 | 2.0 | 0.30 | 0.04 | — | — | 670 | 200 | 380 | 10 hr | — | 2 | 2 | 2 | ◎ | ○ |
| | 2 | " | 9.4 | 2.0 | 0.10 | 0.04 | — | — | 655 | " | " | " | — | 2 | 2 | 0 | ○ | ○ |
| | 3 | " | 9.4 | 2.0 | 0.30 | 0.04 | — | — | " | " | " | " | — | 1 | 1 | 0 | ◎ | ◎ |
| | 4 | " | 9.5 | 1.9 | 0.60 | 0.05 | — | — | " | " | " | " | — | 1 | 1 | 0 | ◎ | ◎ |
| | 5 | " | 9.5 | 1.9 | 0.93 | 0.04 | — | — | 690 | " | " | " | — | 2 | 2 | 0 | ◎ | ○ |
| | 6 | " | 9.4 | 2.0 | 0.31 | 0.06 | — | — | " | " | " | " | — | 2 | 1 | 0 | ◎ | ○ |
| | 7 | " | 9.5 | 2.0 | 0.31 | 0.13 | — | — | 685 | " | " | " | — | 3 | 2 | 0 | ◎ | ○ |
| | 8 | " | 9.5 | 2.0 | 0.30 | 0.04 | 0.25 | 0.22 | 655 | " | " | " | — | 1 | 1 | 0 | ○ | ○ |
| | 9 | Ti-IF | 9.4 | 2.0 | 0.30 | 0.04 | — | — | " | " | " | " | — | 1 | 1 | 0 | ◎ | ◎ |
| | 10 | Al-k | 9.4 | 2.0 | 0.30 | 0.04 | — | — | " | 60 | " | " | — | 1 | 1 | 0 | ◎ | ◎ |
| | 11 | " | " | " | " | " | — | — | " | 120 | " | " | — | 1 | 1 | 0 | ◎ | ◎ |
| | 12 | " | " | " | " | " | — | — | " | 300 | " | " | — | 2 | 2 | 0 | ◎ | ○ |
| | 13 | " | " | " | " | " | — | — | " | 200 | 500 | 7 sec | — | 1 | 1 | 0 | ◎ | ◎ |
| | 14 | " | " | " | " | " | — | — | " | " | 480 | 1 min | — | 1 | 1 | 0 | ◎ | ◎ |
| | 15 | " | " | " | " | " | — | — | " | " | 500 | 3 hr | — | 3 | 2 | 0 | ◎ | ○ |
| | 16 | " | " | " | " | " | — | — | " | " | 320 | 24 hr | — | 1 | 1 | 0 | ◎ | ◎ |
| | 17 | " | " | " | " | " | — | — | " | " | 380 | 10 hr | 1-coat | 1 | 1 | 0 | — | ◎ |
| | 18 | " | " | " | " | " | — | — | " | " | " | " | 2-coat | 1 | 1 | 0 | — | ◎ |
| Comp. Example | 1 | Al-k | 9.4 | 2.0 | 0.01 | 0.00 | — | — | 655 | 200 | 500 | 7 sec | — | 3 | 2 | 40 | Δ | x |
| | 2 | " | 9.5 | 1.9 | 1.12 | 0.04 | — | — | 733 | " | " | " | — | 4 | 4 | 0 | ◎ | x |
| | 3 | " | 9.5 | 2.0 | 0.30 | 0.01 | — | — | 655 | " | " | " | — | 2 | 2 | 11 | ◎ | x |
| | 4 | " | 9.5 | 2.0 | 0.30 | 0.18 | – | – | 718 | " | " | " | — | 4 | 4 | 0 | ◎ | x |
| | 5 | " | 9.4 | 2.0 | 0.30 | 0.04 | 0.60 | 0.57 | 655 | " | " | " | — | 1 | 1 | 0 | x | x |
| | 6 | " | 9.4 | 2.0 | 0.31 | 0.04 | — | — | 655 | 40 | " | " | — | 1 | 1 | 31 | ◎ | x |
| | 7 | " | " | " | " | " | — | — | " | 200 | 500 | 2 sec | — | 1 | 1 | 10 | ◎ | Δ |
| | 8 | " | " | " | " | " | — | — | " | " | 200 | 10 hr | — | 1 | 1 | 33 | ◎ | x |
| | 9 | " | " | " | " | " | — | — | " | " | 560 | 1 min | — | 1 | 1 | 36 | ◎ | x |

Remarks:
1) RBA: reverse bend CDA: cup contraction
2) overall evaluation: ◎: excellent, ○: fair, Δ: considerably inferior, x: inferior.
3) underline represents the condition outside the range of the present invention (1) Corrosion test:

① Corrosion test after machining:

Bending was made from 0t to 2t with t representing the sheet thickness of each sample having a size of 50×10 mm (adhesion bending), and the sample was subjected to the outdoor exposure test by inclining it at 30° in such a manner as to face the south and leaving it standing for one month in an industrial district. A red rust occurrence area ratio of the machined portion of each sample was determined.

② Flat sheet corrosion test:

Brine spray test (SST) was conducted for each sample having a size of 70×150 mm for 30 days in accordance with JIS Z 2371, and each sample was evaluated in accordance with the white rust occurrence condition after the test on the basis of the following reference. The coated steel sheets were not tested.

@: white rust, not greater than 3%

○: white rust, 3 to 10%

Δ: white rust, 10 to 20% x: white rust, greater than 20%

(2) Coating adhesion:

The coating adhesion test was carried out in the same way as in Example 1.

Contraction was conducted under the condition described above, and the coating peel state on the side surface portion was inspected. The reference for evaluation was the same as that of the reverse bend test of the item ⓪.

In the case of the hot-dipped aluminum coated steel sheets coated in the coating bath not containing Mn and Cr, sufficient corrosion resistance after machining could not be obtained by annealing for a short time. When the amounts of Mn and Cr were too great, the bath temperature rose, so that deterioration of adhesion due to the growth of the alloy layer occurred. When the adhesion amount was too small, or when the annealing condition was not proper, the corrosion resistance after machining could not be improved. When coating was conducted in the bath containing Mn and Cr by adjusting their amounts to a suitable coating adhesion quantity and under suitable annealing conditions, excellent adhesion and the corrosion resistance after machining could be obtained. The effect remained the same even when coating was applied to the steel sheets.

Example 6

Hot-dipped aluminum coating was carried out by using cold rolled steel sheets (0.8 mm thick) having the steel components tabulated in Table 15 and passed through ordinary hot rolling and cold rolling processes. Hot-dipped aluminum coating was conducted in a refining furnace-reducing furnace type line, and the thickness of coating was adjusted after plating by a gas wiping method. Thereafter, the cooling rate was adjusted by cooling by air. The coating bath composition in this case was basically composed of Al-2% Fe, and Si, Mn and Cr were added to this bath. Fe at this time was provided from the coating devices in the bath and from the strip. The appearance of plating was excellent without defective coating. Further, some of the samples after coating were annealed in air by using a box annealing furnace. The hot-dipped aluminum coating condition and the annealing condition at this time are tabulated in Tables 16 and 17. The performance of each hot-dipped aluminum coated steel sheets so produced, as a fuel tank, was evaluated. The evaluation method in this case is as follows.

TABLE 15

| | Steel components of samples (wt %) | | | | | | | | |
|---|---|---|---|---|---|---|---|---|---|
| | C | Si | Mn | P | S | Ti | Al | N | B |
| A | 0.003 | 0.03 | 0.31 | 0.015 | 0.015 | 0.04 | 0.05 | 0.0024 | — |
| B | 0.002 | 0.02 | 0.24 | 0.011 | 0.020 | 0.03 | 0.06 | 0.0030 | 0.0008 |

(1) Analysis method of coating layer, alloy layer composition and thickness:

① Coating layer:

Only the coating layer was peeled by electrolytic peeling in 3% NaOH+1% $AlCl_3 \cdot 6H_2O$ and the solution was used as a solution for analyzing the coating layer composition. Each element was quantitatively analyzed.

② Alloy layer:

After the electrolytic peeling described above, the alloy layer was peeled by caustic soda to obtain a solution for analyzing the alloy layer composition, and each element was quantitatively analyzed.

③ Thickness of alloy layer:

The thickness of the alloy layer was measured by a 400× photo of the section.

(2) Evaluation of press machinability:

The molding test was carried out at a contraction ratio of 2.3 by using a cylindrical punch having a diameter of 50 mm by using a hydraulic molding tester. At this time, a wrinkle support pressure was 500 kg/cm$^2$, and moldability was evaluated in accordance with the following indexes.

[Evaluation reference]

@: moldable, free from defect of coating layer

○: moldable, crack occurred in coating layer

Δ: moldable, peel occurred in coating layer x: unmoldable (crack occurred in raw sheet)

(3) Evaluation of corrosion resistance of inner surface after machining:

Each sample was contracted and machined, into a cylinder having a flange width of 20 mm, a diameter of 50 mm, a depth of 25 mm and a flat bottom, by the hydraulic molding tester described above. Next, after 20 cc of each of six kinds of fuels listed below was placed in the cylinder, the cylinder was closed by a glass cover and a silicone rubber ring. After each sample was left standing at room temperature for 3 months, the corrosion condition of the material was observed.

It is known that the fuel undergoes oxidation deterioration during use and organic acids are formed. To simulate this condition, a degraded gasoline was prepared by putting oxygen and the gasoline into the container and holding them at 100° C. and 7 mmHg for 10 hours. When the fuel inside the tank decreased, the moisture in air inside the tank entered at the time of the supply of the fuel sometimes condensed at the gaseous phase portion and mixed into the fuel. To grasp the influences of the moisture and the influences of gasoline deterioration, evaluation was also made by using the fuel to which distilled water was added.

[Fuels used]

① gasoline

② degraded gasoline 90%+distilled water 10%

③ methanol 15%+gasoline 85%+distilled water 10%

[Evaluation reference]

@: red rust occurrence less than 0.1% and no change

○: red rust occurrence 0.1% to less than 1%, and slight white rust

Δ: red rust occurrence 1% to less than 5%, and slight white rust x: red rust occurrence 5% to less than 15% or remarkable white rust xx: red rust occurred on entire surface

TABLE 16

Detail of samples and result of performance evaluation

| | | base | coating bath composition (wt %) | | | | | | bath temp. | coating layer composition (wt %) | | | | | |
|---|---|---|---|---|---|---|---|---|---|---|---|---|---|---|---|
| | No. | sheet | Si | Fe | Mn | Cr | Zn | Sn | (°C.) | Si | Fe | Mn | Cr | Zn | Sn |
| Example | 1 | A | 3.7 | 1.9 | 0.32 | 0.04 | — | — | 680 | 3.4 | 0.48 | 0.04 | 0.005 | — | — |
| | 2 | A | 6.0 | 2.0 | 0.32 | 0.04 | — | — | 670 | 5.7 | 0.45 | 0.04 | 0.005 | — | — |
| | 3 | A | 9.4 | 2.0 | 0.30 | 0.04 | — | — | 655 | 9.0 | 0.44 | 0.04 | 0.005 | — | — |
| | 4 | A | 11.7 | 2.0 | 0.31 | 0.04 | — | — | 655 | 11.0 | 0.45 | 0.04 | 0.005 | — | — |
| | 5 | A | 9.4 | 2.0 | 0.08 | 0.04 | — | — | 655 | 9.0 | 0.44 | 0.01 | 0.005 | — | — |
| | 6 | A | 9.4 | 2.0 | 0.17 | 0.04 | — | — | 655 | 9.1 | 0.43 | 0.02 | 0.005 | — | — |
| | 7 | A | 9.4 | 2.0 | 0.29 | 0.04 | — | — | 655 | 9.0 | 0.40 | 0.04 | 0.005 | — | — |
| | 8 | A | 9.5 | 1.9 | 0.61 | 0.05 | — | — | 655 | 9.0 | 0.44 | 0.07 | 0.006 | — | — |
| | 9 | A | 9.5 | 1.9 | 0.93 | 0.04 | — | — | 690 | 9.0 | 0.45 | 0.13 | 0.006 | — | — |
| | 10 | A | 9.4 | 2.0 | 0.31 | 0.03 | — | — | 655 | 9.0 | 0.43 | 0.05 | 0.004 | — | — |
| | 11 | A | 9.5 | 2.0 | 0.31 | 0.08 | — | — | 655 | 9.0 | 0.44 | 0.04 | 0.009 | — | — |
| | 12 | A | 9.5 | 2.0 | 0.31 | 0.13 | — | — | 685 | 9.0 | 0.44 | 0.04 | 0.02 | — | — |
| | 13 | B | 9.4 | 2.0 | 0.30 | 0.04 | — | — | 655 | 9.1 | 0.40 | 0.04 | 0.005 | — | — |
| | 14 | A | 9.5 | 2.0 | 0.31 | 0.03 | 0.01 | 0.01 | 655 | 9.0 | 0.45 | 0.05 | 0.004 | 0.01 | 0.01 |
| | 15 | A | 9.5 | 2.0 | 0.30 | 0.03 | 0.45 | 0.01 | 655 | 9.0 | 0.25 | 0.05 | 0.004 | 0.42 | 0.01 |
| | 16 | A | 9.4 | 2.0 | 0.31 | 0.03 | 0.01 | 0.44 | 655 | 9.0 | 0.22 | 0.05 | 0.004 | 0.01 | 0.44 |
| | 17 | A | 9.4 | 2.0 | 0.30 | 0.04 | — | — | 655 | 9.0 | 0.44 | 0.04 | 0.005 | — | — |
| | 18 | A | 9.4 | 2.0 | 0.30 | 0.04 | — | — | 655 | 9.0 | 0.44 | 0.04 | 0.005 | — | — |
| | 19 | A | 9.4 | 2.0 | 0.30 | 0.04 | — | — | 655 | 9.0 | 0.44 | 0.04 | 0.005 | — | — |
| | 20 | A | 9.4 | 2.0 | 0.30 | 0.04 | — | — | 655 | 9.0 | 0.44 | 0.04 | 0.005 | — | — |
| Comp. Example | 1 | A | 2.2 | 1.9 | 0.31 | 0.04 | — | — | 690 | 2.0 | 0.52 | 0.04 | 0.005 | — | — |
| | 2 | A | 13.5 | 2.0 | 0.30 | 0.05 | — | — | 655 | 12.5 | 0.45 | 0.04 | 0.006 | — | — |
| | 3 | A | 9.4 | 1.9 | 0.03 | 0.05 | — | — | 655 | 9.0 | 0.44 | 0.003 | 0.005 | — | — |
| | 4 | A | 9.5 | 1.9 | 1.12 | 0.04 | — | — | 733 | 9.1 | 0.45 | 0.15 | 0.005 | — | — |
| | 5 | A | 9.5 | 2.0 | 0.30 | 0.01 | — | — | 654 | 9.0 | 0.42 | 0.23 | 0.001 | — | — |
| | 6 | A | 9.5 | 2.0 | 0.30 | 0.18 | — | — | 718 | 9.1 | 0.46 | 0.04 | 0.02 | — | — |
| | 7 | A | 9.4 | 2.0 | 0.31 | 0.03 | 0.61 | 0.58 | 655 | 9.0 | 0.16 | 0.05 | 0.004 | 0.60 | 0.57 |
| | 8 | A | 9.4 | 2.0 | 0.30 | 0.04 | — | — | 655 | 9.0 | 0.44 | 0.04 | 0.005 | — | — |
| | 9 | A | molten Pb-8% Sn alloy coating (both surfaces 100 g/m$^2$) + phosphate processing | | | | | | | | | | | | |
| | 10 | A | electrozinc coating (both surfaces 80 g/m$^2$) + chromate processing (one surface Cr: 60 mg/m$^2$) | | | | | | | | | | | | |

| | | base | alloy layer mean composition (wt %) | | | | | | alloy layer thickness |
|---|---|---|---|---|---|---|---|---|---|
| | No. | sheet | Si | Fe | Mn | Cr | Zn | Sn | (μm) |
| Example | 1 | A | 5.5 | 36.9 | 1.3 | 0.13 | — | — | 5.0 |
| | 2 | A | 9.1 | 35.8 | 1.2 | 0.12 | — | — | 3.2 |
| | 3 | A | 11.2 | 37.5 | 1.5 | 0.12 | — | — | 2.8 |
| | 4 | A | 14.8 | 38.0 | 1.3 | 0.13 | — | — | 2.8 |
| | 5 | A | 11.5 | 37.8 | 0.3 | 0.13 | — | — | 2.5 |
| | 6 | A | 11.3 | 37.4 | 0.7 | 0.13 | — | — | 2.6 |
| | 7 | A | 11.9 | 36.4 | 1.1 | 0.14 | — | — | 2.8 |
| | 8 | A | 11.5 | 36.7 | 2.2 | 0.14 | — | — | 3.0 |
| | 9 | A | 11.6 | 35.8 | 3.5 | 0.12 | — | — | 3.9 |
| | 10 | A | 11.8 | 37.6 | 1.2 | 0.10 | — | — | 2.8 |
| | 11 | A | 11.8 | 37.8 | 1.0 | 0.29 | — | — | 2.8 |
| | 12 | A | 11.2 | 38.1 | 1.3 | 0.41 | — | — | 3.8 |
| | 13 | B | 11.3 | 37.5 | 1.3 | 0.13 | — | — | 2.8 |
| | 14 | A | 11.4 | 36.9 | 1.2 | 0.10 | 0.01 | 0.01 | 2.8 |
| | 15 | A | 11.2 | 37.5 | 1.1 | 0.11 | 0.32 | 0.01 | 2.7 |
| | 16 | A | 11.6 | 37.3 | 1.2 | 0.12 | 0.01 | 0.01 | 2.8 |
| | 17 | A | 11.2 | 37.5 | 1.5 | 0.12 | — | — | 2.8 |
| | 18 | A | 11.2 | 37.5 | 1.5 | 0.12 | — | — | 2.9 |
| | 19 | A | 11.2 | 37.5 | 1.5 | 0.12 | — | — | 2.8 |
| | 20 | A | 11.2 | 37.5 | 1.5 | 0.12 | — | — | 2.8 |
| Comp. Example | 1 | A | 3.8 | 37.9 | 1.5 | 0.13 | — | — | 8.5 |
| | 2 | A | 17.5 | 37.7 | 1.4 | 0.13 | — | — | 2.8 |
| | 3 | A | 11.1 | 38.9 | 0.1 | 0.14 | — | — | 2.5 |
| | 4 | A | 11.9 | 35.0 | 4.6 | 0.13 | — | — | 5.4 |
| | 5 | A | 11.5 | 37.6 | 0.5 | 0.04 | — | — | 2.6 |
| | 6 | A | 11.5 | 36.6 | 1.3 | 0.61 | — | — | 5.6 |
| | 7 | A | 11.0 | 37.3 | 1.4 | 0.10 | 0.39 | 0.01 | 2.7 |
| | 8 | A | 11.2 | 37.5 | 1.5 | 0.12 | — | — | 9.8 |

TABLE 16-continued

| Detail of samples and result of performance evaluation | | |
|---|---|---|
| 9 | A | molten Pb-8% Sn alloy coating (both surfaces 100 g/m$^2$) + phosphate processing |
| 10 | A | electrozinc coating (both surfaces 80 g/m$^2$) + chromate processing (one surface Cr: 60 mg/m$^2$) |

TABLE 17

| | No. | annealing condition temp. (°C.) | annealing condition time (hr) | press mold-ability | corrosion resistance after machining 1 | 2 | 3 | overall evalua-tion |
|---|---|---|---|---|---|---|---|---|
| Example | 1 | nil. | nil. | ○ | ◎ | Δ | ◎–Δ | ○ |
| | 2 | " | " | ◎ | ◎ | ○ | ○ | ◎–○ |
| | 3 | " | " | ◎ | ◎ | ○ | ○ | ◎–○ |
| | 4 | " | " | ◎ | ◎ | ○ | ○ | ◎–○ |
| | 5 | " | " | ◎ | ◎ | ○–Δ | ○–Δ | ○ |
| | 6 | " | " | ◎ | ◎ | ○–Δ | ○ | ○ |
| | 7 | " | " | ◎ | ◎ | ○ | ○ | ◎–○ |
| | 8 | " | " | ◎ | ◎ | ○ | ○ | ◎–○ |
| | 9 | " | " | ◎–○ | ◎ | ○–Δ | ○ | ○ |
| | 10 | " | " | ◎ | ◎ | ○ | ○ | ◎–○ |
| | 11 | " | " | ◎ | ◎ | ○ | ○ | ◎–○ |
| | 12 | " | " | ◎–○ | ◎ | ○–Δ | ○ | ○ |
| | 13 | " | " | ◎ | ◎ | ○ | ○ | ◎–○ |
| | 14 | " | " | ◎ | ◎ | ○ | ○ | ◎–○ |
| | 15 | " | " | ◎ | ◎ | ○–Δ | ○–Δ | ○ |
| | 16 | " | " | ◎ | ◎ | ○–Δ | ○–Δ | ○ |
| | 17 | 380 | 10 | ◎ | ◎ | ◎ | ◎ | ◎ |
| | 18 | 430 | 5 | ◎ | ◎ | ◎ | ◎ | ◎ |
| | 19 | 250 | 10 | ◎ | ◎ | ○ | ○ | ◎–○ |
| | 20 | 380 | 2 | ◎ | ◎ | ○ | ○ | ◎–○ |
| Comp. Example | 1 | nil. | nil. | Δ | x | xx | x–xx | xx |
| | 2 | " | " | ○ | Δ | x | Δ–x | x |
| | 3 | " | " | ○ | ○ | x | x | x |
| | 4 | " | " | ○–Δ | ○ | x | x | x |
| | 5 | " | " | ○ | ○ | x | Δ | x |
| | 6 | " | " | ○–Δ | ○ | x | x | x |
| | 7 | " | " | ◎ | ○ | x | Δ | x |
| | 8 | 520 | 10 | Δ | x | xx | xx | xx |
| | 9 | nil. | nil. | ◎ | ◎ | x | Δ | x |
| | 10 | " | " | ◎ | ○ | xx | x | xx |

The results of these evaluations are tabulated in Table 17. When the amount of Si was small in the aluminum coating bath composition (Comparative Example 1) or when the annealing temperature after coating was too high (Comparative Example 8), the alloy layer grew thickly and excessively, so that peeling of the coating occurred at the time of press machining. The corrosion resistance dropped remarkably after machining in this case. When the amount of Si was too great in the coating bath (Comparative Example 2), the ductility of the coating layer was deteriorated and consequently, adhesion was deteriorated. Further, because the corrosion resistance itself was deteriorated, the deterioration of these properties invited deterioration of the corrosion resistance after machining. When the amounts of Mn and Cr were too small (Comparative Examples 3 and 5), concentration of these elements into the alloy layer was not sufficient, and the corrosion resistance after machining was insufficient, too.

When the amounts of these elements were too great (Comparative Examples 4 and 6), on the contrary, the elements were not dissolved unless the bath temperature was raised. Consequently, the alloy layer excessively grew and performance dropped. When the amounts of Sn and Zn were too great in the coating bath (Comparative Example 7), the corrosion resistance of the coating layer deteriorated. In the case of the conventional materials such as Pb-Sn alloy coating, zinc coating, etc (Comparative Examples 9 and 10), the corrosion resistance of the coating layer itself was insufficient and performance dropped. As represented by Examples Nos. 1 to 16 of the present invention, good machinability (adhesion and corrosion resistance after machining) could be obtained when the conditions of the bath components were all suitable. Further, when annealing was conducted, performance could be further improved (Examples 17 and 18 of this invention). When annealing was not sufficient such as the low annealing temperature and the short annealing time (Examples 19 and 20 of this invention), the effect of the improvement in performance was not sufficient.

The hot-dipped aluminum coated steel sheet produced by the present invention exhibits excellent corrosion resistance after machining. Particularly because the steel sheet of the present invention is more effective than the steel sheets produced by the conventional methods even within the range where the coating adhesion quantity is small, the range of the application can be broadened, and short time annealing becomes possible, thereby providing a large improvement in the cost of production. Thus, the present invention an important contribution to the industry.

We claim:

1. A corrosion resistant and heat resistant hot-dipped aluminum coated steel sheet, comprising:

a coating layer disposed on the surface of said steel sheet, and consisting of, in terms of percentage by weight:

Si: 2 to 15%,

Fe: not greater than 1.2%,

Mn: 0.005 to 0.6%,

Cr: 0.002 to 0.05%, and the balance of Al and unavoidable impurities including Sn and Zn, wherein Sn the amount of and Zn in total in said impurities is from 0 to 1%, and an alloy layer disposed between said steel sheet and said coating layer, having a thickness of not greater than 7 μm, and having a composition consisting of, in terms of percentage by weight:

Fe: 20 to 50%,

Si: 3 to 20%,

Mn: 0.1 to 10%,

Cr: 0.05 to 1%, and the balance of Al and unavoidable impurities.

2. A corrosion resistant and heat resistant hot-dipped aluminum coated steel sheet according to claim 1, wherein a chromate processed coat film and an organic resin coat film on said chromate processed coat film are disposed on the surface of said coating layer of said hot-dipped aluminum coated steel sheet.

3. A corrosion resistant and heat resistant hot-dipped aluminum coated steel sheet according to claim 2, wherein said organic resin coat film is transparent and has a thickness of 1 to 15 μm.

4. A corrosion resistant and heat resistant hot-dipped aluminum coated steel sheet according to claim 1, wherein the steel sheet consists of, in terms of percentage by weight:

C: not greater than 0.02%,

Mn: 0.1 to 0.6%,

Ti: 0.1 to 0.5%,

N: not greater than 0.004%,

Al: 0.01 to 0.08%, and the balance substantially consisting of Fe and unavoidable impurity elements.

5. A corrosion resistant and heat resistant hot-dipped aluminum coated steel sheet according to claim 4, wherein said steel contains not greater than 1% of Cr in terms of percentage by weight.

6. A corrosion resistant and heat resistant hot-dipped aluminum coated steel sheet according to claim 1, wherein said steel sheet contains, in terms of percentage by weight:

at least one member selected from the group consisting of not greater than 1.5% of Si, not greater than 0.1% of P and not greater than 0.0003% of B, in addition to the steel composition consisting of, in terms of percentage by weight:

C: not greater than 0.02%,

Mn: 0.6 to 2%,

Ti: 0.1 to 0.5%,

N: not greater than 0.004%,

Al: 0.01 to 0.08%, and the balance substantially consisting of Fe and unavoidable impurity elements.

7. A corrosion resistant and heat resistant hot-dipped aluminum coated steel sheet according to claim 1, wherein said steel sheet consists of, in terms of percentage by weight:

C: not greater than 0.01%,

Si: not greater than 0.1%,

N: 0.0015 to 0.006%,

Al: not greater than 0.01%, and the balance substantially consisting of Fe and unavoidable impurity elements.

8. A chromium-containing type corrosion resistant and heat resistant hot-dipped aluminum coated steel sheet according to claim 1, wherein said steel sheets consists of, in terms of percentage by weight:

C: not greater than 0.02%,

Mn: 0.1 to 1.5%,

Si: not greater than 0.2%,

Ti: 0.1 to 0.5%,

Cr: 1 to 9%,

N: not greater than 0.004%,

Al: 0.01 to 0.08%, and the balance substantially consisting of Fe and unavoidable impurity elements.

9. A stainless type corrosion resistant and heat resistant hot-dipped aluminum coated steel sheet, comprising a stainless steel sheet containing, as steel components thereof, in terms of percentage by weight:

C: not greater than 0.02%,

Mn: 0.1 to 1.5%,

Si: not greater than 0.2%,

Ti: 0.1 to 0.5%,

Cr: 10 to 25%,

N: not greater than 0.004%,

Al: 0.01 to 0.08%, at least one member selected from the group consisting of:

Ni: 0.1 to 1%,

Mo: 0.1 to 2%, and

Cu: 0.1 to 1%, and the balance substantially consisting of Fe and unavoidable impurity elements;

said steel sheet including:

a coating layer consisting of, in terms of percentage by weight:

Si: 2 to 15%,

Fe: not greater than 1.2%,

Mn: 0.005 to 0.6%,

Cr: 0.05 to 0.2%, and the balance consisting of Al and unavoidable impurities including Sn and Zn, wherein Sn the amount of and Zn in total in said unavoidable impurities is from 0 to 1%, and disposed on the surface of said steel sheet; and an alloy layer disposed between said steel sheet and said coating layer, having a thickness of not greater than 7 μm and having a composition consisting of, in terms of percentage by weight:

Fe: 20 to 50%,

Si: 3 to 20%,

Mn: 0.1 to 10%,

Cr: 1 to 5%, and the balance consisting of Al an unavoidable impurities.

10. A production method for a corrosion resistant and heat resistant hot-dipped aluminum coated steel sheet comprising:

forming a coating layer consisting of, in terms of percentage by weight:

Si: 2 to 15%,

Fe: not greater than 1.2%,

Mn: 0.005 to 0.6%,

Cr: 0.002 to 0.05%, and the balance consisting of Al and unavoidable impurities including Sn and Zn, wherein Sn the amount of and Zn in total in said impurities is from 0 to 1%; on the surface of a steel sheet; and forming an alloy layer between said steel sheet and said coating layer, having a thickness of not greater than 7 μm and having a composition consisting of, in terms of percentage by weight:

Fe: 20 to 50%,

Si: 3 to 20%,

Mn: 0.1 to 10%,

Cr: 0.05 to 1%, and the balance consisting of Al and unavoidable impurities;

said alloy layer formed by using a bath having a composition consisting of:

Si: 3 to 15%,

Fe: 0.5 to 3.5%,

Mn: 0.05 to 1.5%,

Cr: 0.01 to 0.2%, and the balance consisting of Al an unavoidable impurities, wherein Sn and Zn in total in said impurities is not greater than 1%.

11. A production method for a corrosion resistant and heat resistant hot-dipped aluminum coated steel sheet according to claim 10, wherein a Cr concentration in said coating bath is 0.01 to less than 0.1% in terms of percentage by weight.

12. A production method for a corrosion resistant and heat resistant hot-dipped aluminum coated steel sheet according to claim 10, wherein a deposition quantity of said coating layer is at least 60 $g/m^2$ on both surfaces of said steel sheet, and heat-treatment is carried out in a region encompassed by the following coordinates axes A, B, C, D, E and F:

A: (5 seconds, 510° C.), D: (30 hours, 300° C.),

B: (1 minute, 530° C.), E: (1 minute, 300° C.),

C: (30 hours, 530° C.), F: (5 seconds, 450° C.).

13. A production method for a corrosion resistant and heat resistant hot-dipped aluminum coated steel sheet for building material according to claim 12, wherein chromate processing and resin coating are carried out in succession onto said coating layer.

* * * * *

UNITED STATES PATENT AND TRADEMARK OFFICE

CERTIFICATE OF CORRECTION

PATENT NO. : 5,789,089

DATED : August 4, 1998

INVENTOR(S) : Jun MAKI, et al.

It is certified that error appears in the above-identified patent and that said Letters Patent is hereby corrected as shown below:

Column 36, line 46, delet "Sn" after "wherein" and insert --Sn-- after "amount of".

Column 37, line 45, change "sheets" to --sheet--.

Column 38, line 18, delete "Sn" after "wherein" and insert --Sn-- after "amount of".

Column 38, line 43, delete "Sn" after "wherein" and insert --Sn-- after "amount of".

Column 38, line 63, change "an" to --and--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*